US010876249B2

(12) United States Patent
Kamii et al.

(10) Patent No.: US 10,876,249 B2
(45) Date of Patent: Dec. 29, 2020

(54) DRYER AND METHOD FOR CONTROLLING SAME

(71) Applicant: SAMSUNG ELECTRONICS CO., LTD., Suwon-si (KR)

(72) Inventors: Toshihiro Kamii, Yokohama (JP); Hisashi Kawasaki, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 485 days.

(21) Appl. No.: 15/531,619

(22) PCT Filed: Nov. 25, 2015

(86) PCT No.: PCT/KR2015/012714
§ 371 (c)(1),
(2) Date: May 30, 2017

(87) PCT Pub. No.: WO2016/085252
PCT Pub. Date: Jun. 2, 2016

(65) Prior Publication Data

US 2018/0282934 A1 Oct. 4, 2018

(30) Foreign Application Priority Data

Nov. 28, 2014 (JP) ..... 2014-242102
Nov. 28, 2014 (JP) ..... 2014-242247
(Continued)

(51) Int. Cl.
*D06F 58/30* (2020.01)
*D06F 58/20* (2006.01)
(Continued)

(52) U.S. Cl.
CPC ..... *D06F 58/30* (2020.02); *D06F 58/20* (2013.01); *D06F 58/38* (2020.02);
(Continued)

(58) Field of Classification Search
CPC .. D06F 58/28; D06F 58/20; D06F 2058/2848; D06F 2058/289;
(Continued)

(56) References Cited

U.S. PATENT DOCUMENTS 8,919,010 B2 * 12/2014 Doh ..... D06F 58/28 34/495
2006/0048549 A1 * 3/2006 Matsukura ..... D06F 37/203 68/12.06
2009/0049709 A1 * 2/2009 Doh ..... D06F 58/28 34/524

FOREIGN PATENT DOCUMENTS

JP H0584398 A 4/1993
JP H0691097 A 4/1994
(Continued)

OTHER PUBLICATIONS

Form PCT/ISA/210; International Search Report dated Mar. 2, 2016 in corresponding International Patent Application No. PCT/KR2015/012714 (3 pages) (2 pages English Translation).
(Continued)

*Primary Examiner* — Jessica Yuen
(74) *Attorney, Agent, or Firm* — Staas & Halsey LLP

(57) ABSTRACT

The present invention to provide a dryer having high drying efficiency and possible to energy saving operation.
A controller (3) of the dryer (D) include an information receiver (33) configured to collect drying object information about a state of the Object© to be dried in the drum (2).
A controller (3) of the dryer (D) controls an output of the heater to have an output per unit time lower than a predetermined output of normal based on a state of the object to be dried collected by the information receiver, and controls a drying ending time based on a state of the object to be dried and an output of the heater.

12 Claims, 19 Drawing Sheets

(30) Foreign Application Priority Data

Oct. 2, 2015 (JP) ..... 2015-196836
Nov. 25, 2015 (KR) ..... 10-2015-0165281

(51) Int. Cl.

| | |
|---|---|
| ***D06F 58/38*** | (2020.01) |
| ***D06F 103/02*** | (2020.01) |
| ***D06F 103/04*** | (2020.01) |
| ***D06F 103/08*** | (2020.01) |
| ***D06F 103/36*** | (2020.01) |
| ***D06F 105/24*** | (2020.01) |
| ***D06F 105/28*** | (2020.01) |

(52) U.S. Cl.
CPC ..... *D06F 2103/02* (2020.02); *D06F 2103/04* (2020.02); *D06F 2103/08* (2020.02); *D06F 2103/36* (2020.02); *D06F 2105/24* (2020.02); *D06F 2105/28* (2020.02)

(58) Field of Classification Search
CPC ..... D06F 2058/2864; D06F 2058/2829; D06F 2058/2861; D06F 58/30; D06F 58/38; D06F 2103/02; D06F 2103/04; D06F 2103/08; D06F 2103/36; D06F 2105/24; D06F 2105/28; D06F 58/02; D06F 58/26
See application file for complete search history.

(56) References Cited

FOREIGN PATENT DOCUMENTS

| | | | |
|---|---|---|---|
| JP | H07303796 | A | 11/1995 |
| JP | H07323195 | A | 12/1995 |
| KR | 10-2004-0057888 | | 7/2004 |
| WO | WO 2016/085252 | A1 | 6/2016 |

OTHER PUBLICATIONS

Form PCT/ISA/237; Written Opinion dated Mar. 2, 2016 in corresponding International Patent Application No. PCT/KR2015/012714 (8 pages).
Chinese Office Action dated Jul. 10, 2019 in related Chinese Application No. 201580073774.X.

* cited by examiner

DRYER AND METHOD FOR CONTROLLING SAME

CROSS-REFERENCE TO RELATED APPLICATIONS

This application is a U.S. national stage application under 35 USC 371 of PCT International Patent Application No. PCT/KR2015/012714, filed on Nov. 25, 2015, which claims the benefit of Japanese Patent Application No. 2014-242102, filed on Nov. 28, 2014, Japanese Patent Application No. 2014-242247, filed on Nov. 28, 2014, Japanese Patent Application No. 2015-196836, filed on Oct. 2, 2015, and Korean Patent Application No. 10-2015-0165281, filed on Nov. 25, 2015, the contents of which are incorporated herein by reference.

TECHNICAL FIELD

The present invention relates to a dryer used to dry an object, e.g., clothes, and method for controlling the same.

BACKGROUND ART

A clothes dryer is known to determine a material or form of clothes and perform drying operation depending on the material or form of the clothes, which is an object to be dried.

For example, patent document 1 (JP patent publication No. 7-303796) discloses a clothes dryer, in which a plurality of electrode sensors with electric resistance differing according to whether wet clothes makes contact are installed, different thresholds are set for the plurality of sensors, and the nature of clothes to be dried is estimated based on comparison between the threshold and electric resistance measured by each electrode sensor.

Furthermore, patent document 2 (JP patent publication No. 2013-128637) discloses a clothes dryer, in which a detector is installed to detect an extent of dryness of clothing and connected to a spinning tub and back plate of a cover, thereby preventing end of drying in the state of incomplete dryness.

Disclosure

Technical Problem

Even if objects to be dried are of the same material or have the same amount (weight) of fabrics and are dried for the same period of time at the same power, problems arise that the objects are not dried if the objects are large clothes, e.g., sheets, and the objects may not be evenly dried if the objects are multiple small towels.

As such, although there is little difference in amount of moisture to be dried, drying results are sometimes different even under the same condition of operation. The conventional dryer considered not the size of clothing but only an amount of fabrics. Also, operation time of the dryer is set by a wide margin to completely dry clothes no matter what size the clothing has.

However, in an operating method of the dryer as described above, in a case that objects to be dried have a lot of small fabrics, the objects may be overly heated or aired even if they have been sufficiently dried, thereby consuming unnecessary electric power. On the contrary, although there exists an amount of heat required to evaporate all the moisture in the heated air blown into the drum, a sufficient amount of moisture may not be taken from an object to be dried if the object is a large piece of cloth and the heated air that is still able to take the moisture may be unnecessarily thrown out, which decreases the drying efficiency.

The clothes dryer in the patent document 1 is configured to be able to change an amount of combustion of a gas burner in stages and adjust duration of each amount of combustion of the gas burner depending on the detected nature of clothes (e.g., an amount of the clothes, an amount of moisture, texture of the clothes) to be dried.

However, regardless of the nature of clothes to be dried, the way of gradually decreasing the output power of the gas burner from the maximum amount of gas combustion remains the same, so there is a problem that energy saving is limited with a total sum of drying operation periods.

Furthermore, even for clothes having fabrics that are likely to be damaged from drying at high temperature, the clothes to be dried may be damaged at high temperature (with the maximum amount of gas combustion) even for a short period of time.

Moreover, a plurality of electrode sensors need to be installed to estimate the nature of clothes to be dried causes increased complexity or expenses of configuration. The present invention aims to perform efficient energy saving drying operation depending on a combination of forms or types of the clothing to be dried.

Technical Solution

Therefore, it is an aspect of the present disclosure to provide a dryer including a controller configured to control an output of a heater to have an output per unit time lower than a predetermined output of normal based on a state of an object to be dried collected by an information receiver, or control a drying ending time based on the state of the object to be dried and the output of the heater.

In accordance with one aspect of the present invention, a dryer includes: a drum configured to receive an object to be dried and be rotated by a motor; a blower configured to introduce air for clothes drying into the drum; a heater configured to heat the air for clothes drying; an information receiver configured to collect drying object information about a state of the object to be dried in the drum; and a controller configured to control an output of the heater to have an output per unit time lower than a predetermined output of normal based on a state of the object to be dried collected by the information receiver, or control a drying ending time based on the state of the object to be dried and the output of the heater.

According to an aspect of the present invention, since an output of the heater is controlled to have an output per unit time lower than a predetermined output of normal based on a state of the object to be dried collected by the information receiver, or a drying ending time is controlled based on the state of the object to be dried and the output of the heater, the object to be dried is completely dried while preventing unnecessary power consumption.

For example, in case a large-sized drying object is tangled, the object is not dried even with a high heating intensity. Therefore, the drying can be controlled to be slowly performed at a low heating intensity.

For example, when an object to be dried (e.g. a clothing) is provided in the form of a small towel and contains a great amount of chemical fabrics, the object has a high drying efficiency. Accordingly, the object can be completely dried even with a low intensity of heating The dryer according to an aspect of the present invention further include: a clothes distributor configured to agitate and distribute the object to be dried in the drum; and an electrode sensor arranged to be able to contact the object to be dried distributed by the clothes distributor and having electric resistance changing by contact with an object containing moisture.

The information receiver is configured to collect a change in electric resistance of the electrode sensor as the drying object information about a state of the object to be dried, and the controller is configured to convert the change in electric resistance of the electrode sensor received by the information receiver to a pulse signal. The controller is configured to integrate count of the pulse signal during a predetermined period at the beginning of a drying process after the start of drying operation, count first operation time from the start of drying operation until the pulse signal count per unit time is less than a threshold, and set a strong heating mode to increase heating intensity of the heater after the first operation time or set an ending time to a normal ending time, if a first condition, in which integration of the pulse signal count is equal to or less than an integration reference value or the first operation time is equal to or longer than a reference time, is satisfied, and set the heating intensity of the heater to a weak heating mode weaker than the strong heating mode or set the operating ending time to be shorter than the normal ending time after the first operation time, if a second condition, in which integration of the pulse signal count exceeds the integration reference value and the first operation time is shorter than the reference time, is satisfied.

The controller of the dryer according to an aspect of the present invention is configured to set the heating intensity of the heater to the weak heating mode or set the drying operating ending time to be shorter than the normal ending time, if the second condition in which integration of the pulse signal count exceeds the integration reference value and the first operation time is shorter than the reference time, is satisfied.

In the case that the second condition is satisfied, that is, in the case of an object to be dried (e.g. a clothing) having a small towel shape and containing a great amount of chemical fabrics, the object has a high drying efficiency and has a high chance of uneven dryness. This is the result of various experiments.

Accordingly, for the drying operation after the first operation time, the heating intensity of the heater is set to a weak heating mode, or the drying operation ending time is set to be shorter than a normal drying operation ending time, so that to energy saving drying operation can be ensured.

In the case that the first condition, in which integration of the pulse signal count is equal to or less than the integration reference value or the first operation time is equal to or longer than the reference time, is satisfied, the heating intensity of the heater is set to a strong heating mode or the drying operating ending time is set to a normal ending time, so that uneven-dryness is effectively prevented.

Accordingly, non-dryness or uneven-dryness of clothes can be prevented while preventing fabric from being damaged or shrunken due to the excessive dry or high temperature, and an energy saving drying operation can be ensured according to the form or combination of clothes to be dried.

The controller of the drier according to an aspect of the present invention may start integrating count of the pulse signal after a predetermined period from the start of drying operation at the beginning of a drying process.

Since the pulse signal count is integrated after the predetermined time from the start of the drying operation, the stability of integration of the pulse signal count can be improved and the accuracy of determining whether to perform the energy saving drying operation can be improved.

The controller of the drier according to an aspect of the present invention is configured to stop controlling heating mode settings of the heater or controlling operation ending time based on the pulse signal, upon reception of a pause of drying operation and resumption of drying operation after a pause from a manipulation means manipulated by a user.

As such, when a drying operation is paused or a drying operation is resumed after a pause, for example, when clothes are added or the temperature of an interior of the drum is lowered, the accuracy of detecting the type or amount of clothes is likely to be lowered.

According to an aspect of the present invention, the degradation of the detection accuracy can be prevented as described above.

The controller according to an aspect of the present invention is configured to control at least one of operation of the drum and activation of the clothes distributor based on the pulse signal, thereby controlling at least one of an extent of movement of an object to be dried and agitation speed of the object to be dried in the drum.

The clothes distributor of the dryer according to an aspect of the present invention includes a plurality of baffles integrally installed in the drum, and the controller is configured to control at least one of revolution per minute (rpm) of the motor, rotation direction of the motor and rotation time of the motor based on the pulse signal.

Accordingly, the optimum extent of movement and frequency of movements of clothes are controlled according to the type and amount of the clothes detected based on the pulse signal, so that the drying performance can be improved and thus the energy saving drying operation can be performed.

The controller of the drier according to an aspect of the present invention is configured to control rpm of the blower, based on the pulse signal.

Accordingly, the optimum amount of an air flow for drying air can be controlled according to the type and amount of the clothes detected based on the pulse signal, so that the drying performance can be improved and thus the energy saving drying operation can be performed.

The controller of the drier according to an aspect of the present invention may control the rpm of the blower to be higher after the first operation time, if the second condition is satisfied.

In this case, the rpm of the fan device is increased after the first operation time when the second condition is satisfied. Accordingly, in a subsequent process following the drying operation, a cooling time required after setting the heater to "off" can be reduced.

In other words, since the operating time of the fan device or the motor in the subsequent process of the drying operation is reduced, the energy saving drying operation can be performed.

The dryer according to an aspect of the present invention further includes a temperature measuring means configured to measure at least one of surrounding temperature and temperature of air introduced to the drum from outside, and the drier is configured to stop controlling heating mode setting of the heater or controlling the operation ending time based on the pulse signal, if the temperature measured by the temperature measuring means is beyond a predetermined temperature range.

Accordingly, the surrounding temperature or the outside temperature of a place where the drier is installed are measured, so that non-dryness or uneven-dryness due to the environment temperature beyond a predetermined temperature range can be effectively prevented.

The controller of the drier according to an aspect of the present invention is configured to fix the heating intensity of the heater after the start of drying operation to a heating mode corresponding to a setting signal, if the setting signal to set a heating mode is input from the manipulator.

Accordingly, a user can select whether to perform an energy saving drying operation or perform a short-time drying operation having no uneven-dryness in a short time, thereby improving convenience of use.

The controller of the drier according to an aspect of the present invention can control the drying operation to be performed in the weak heating mode for a predetermined time from a start of drying operation at the beginning of the drying process.

Since it is possible to select an operation in the weak heating mode for a predetermined time after a start of drying operation, a drying operation ensuring the energy saving can be performed.

The dryer according to an aspect of the present invention further includes a measuring means arranged in at least one of the drum or the body of the dryer for measuring at least one of values corresponding to vibration of the drum, weight of an object to be dried, and acceleration of the drum Accordingly, a drying operation most suitable for the cloth size of the object to be dried can be performed by changing the output of the heater or blower according to the size of the object to be dried which is received by the information receiver.

In more detail, according to the present invention, an output setter is configured to set a target output not based on the weight of the object to be dried but based on the size of the object to be dried, so that a drying operation can be performed with improvement of tangling of an object, facilitation of the object in passing through hot air, and increase in a contact area of an object with hot air, thereby preventing unnecessary power consumption and achieving complete dryness of the object.

For example, when a large-sized object is dried, the drying efficiency is prevented from being lowered due to an excessively great power which is generally set for the large-sized object.

In order to minimize the drying operation time regardless of the size of the object to be dried, and prevent a large-sized object from being incompletely dried, there is provided a size-output relation such that a first target output in a case that the size of the object to be dried is larger than a predetermined size is set to be less than a second target output in a case that the size of the object to be dried is smaller than the predetermined size.

For example, when a large-sized object, such as a sheet, is dried at the second target output that is suitable for drying a plurality of pieces of small towels, the sheet may be bundled into a mass in the drum, so that only the outer side of the sheet is dried and become compact, and hot air does not sufficiently reach the inside of the bundle object, thereby having a difficulty in drying the inside of the bundled object.

Therefore, a large-sized object, such as a sheet, may be slowly dried with the first target output less than the second target output, thereby preventing a part of the object from being incompletely dried.

A large-sized object is considered to require an output greater than an output for a small-sized object, but in practice, an output lower than a normal output is suitable for the large-sized object, and reduces a power consumption.

In order to determine the size of the object to be dried based on information obtained from the drier independent of an input from a user and to perform a drying operation at a power according to the size of the object to be dried, the drier includes a vibration sensor configured to measure a value corresponding to vibration of the drum, a measurement-size relation storage configured to store measurement-size relations which are relations between measurements of the vibration sensor and sizes of the object, and a size determiner configured to output size information depending on the measurement measured by the vibration sensor based on the measurement-size relation to the information receiver.

In order to enhance the drying efficiency and ensure the safety even when the object to be dried is bundled into a big mass and abnormal vibration occurs, the output setter stop outputting of the heater when the measurement measured by the vibration sensor is equal to or greater than a threshold.

In order to implement a drying operation in consideration of not only the size but also the form of the object to be dried and to achieve more superior drying state, the drier further includes a form determiner configured to determine a form of the object to be dried based on the measurement measured by the vibration sensor and a drying time setter configured to set a period from a start to an end of the drying process based on a result of the determination of the form determiner.

As another construction for automatically determining the size of the object to be dried, the drier may include a pair of electrode sensors installed at a position to make contact with the object to be dried in the drum, a measurement-size relation storage configured to store measurement-size relations which are relations between measurements of the electrode sensor and sizes of the object, and a size determiner configured to output size information depending on the measurement measured by the electrode sensor based on the measurement-size relation to the information receiver.

In order that data obtained by the electrode sensor has a superior correlation with the size of the object to be dried and the size of the object to be dried is determined with a high accuracy, the measurement measured by the electrode sensor is set to include a change in an electric resistance per unit time which is set to be shorter than a time for which the drum makes one revolution.

In order to prevent a unstable movement of the object to be dried from affecting the determination of the size of an object to be dried and to increase the accuracy of determining the size, the size determiner outputs size information corresponding to a measurement measured by the electrode sensor after a predetermined time from a start of the drying operation to the information receiver.

In order to keep the drying operation time constant regardless of the size of the object to be dried and to completely dry the object to be dried while achieving power saving, a drying time, which is a time from a start to an end of a drying process, is previously set, and the output setter allows a target output which is set for the heater or blower to be changed for a predetermined period in the drying processing time.

Advantageous Effects

A dryer in the present invention may perform drying operation at power for efficient drying depending on the condition of objects to be dried. Accordingly, drying operation may be performed at sufficient power to sufficiently dry the object to be dried.

DESCRIPTION OF DRAWINGS

FIG. 1 is a side view, and FIG. 2 is a front view.

FIGS. 14 (*b*) and (*c*) are diagrams showing an example of the heater control based on the flowchart in FIG. 13

BEST MODE

Embodiments of the present invention will now be described in conjunction with accompanying drawings. The following description of the embodiments is only by way of example, and is not intended to limit the invention, scope or purpose of the invention.

Configuration of Clothes Dryer

Figure 1:
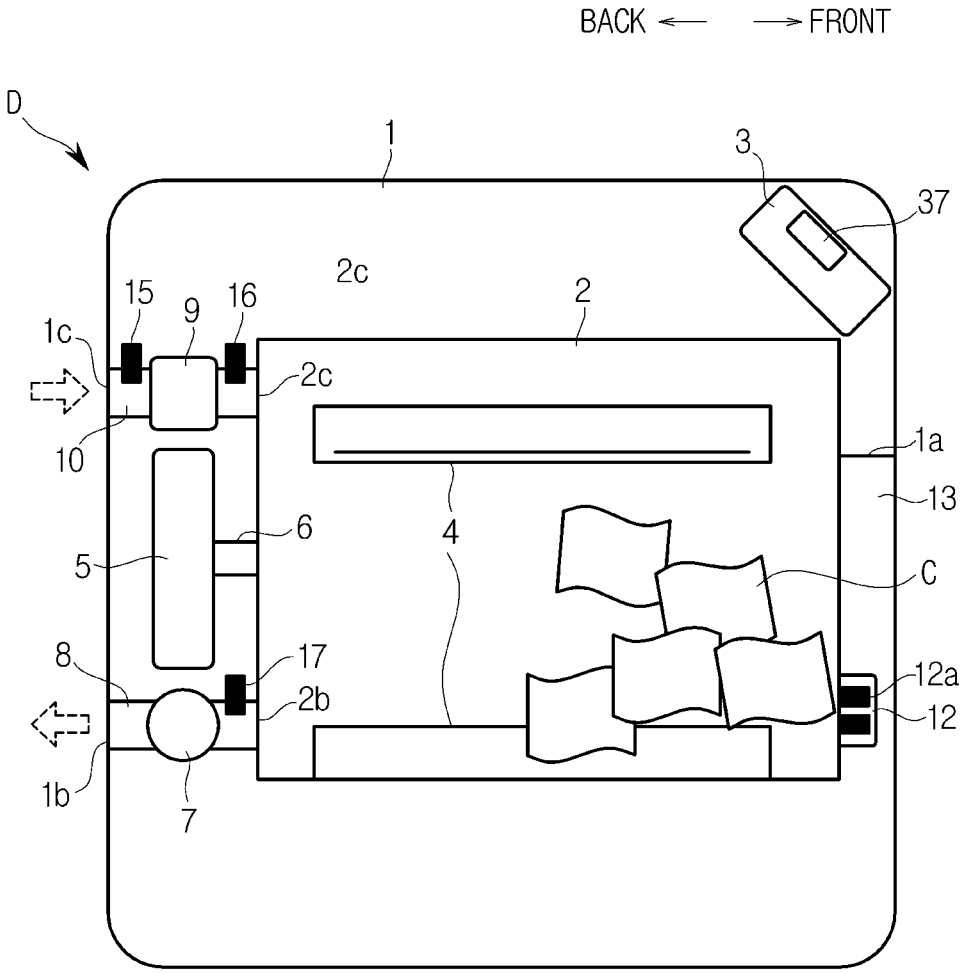
FIGS. 1 and 2 show schematic configuration of a clothes dryer in an embodiment.
Figure 2:
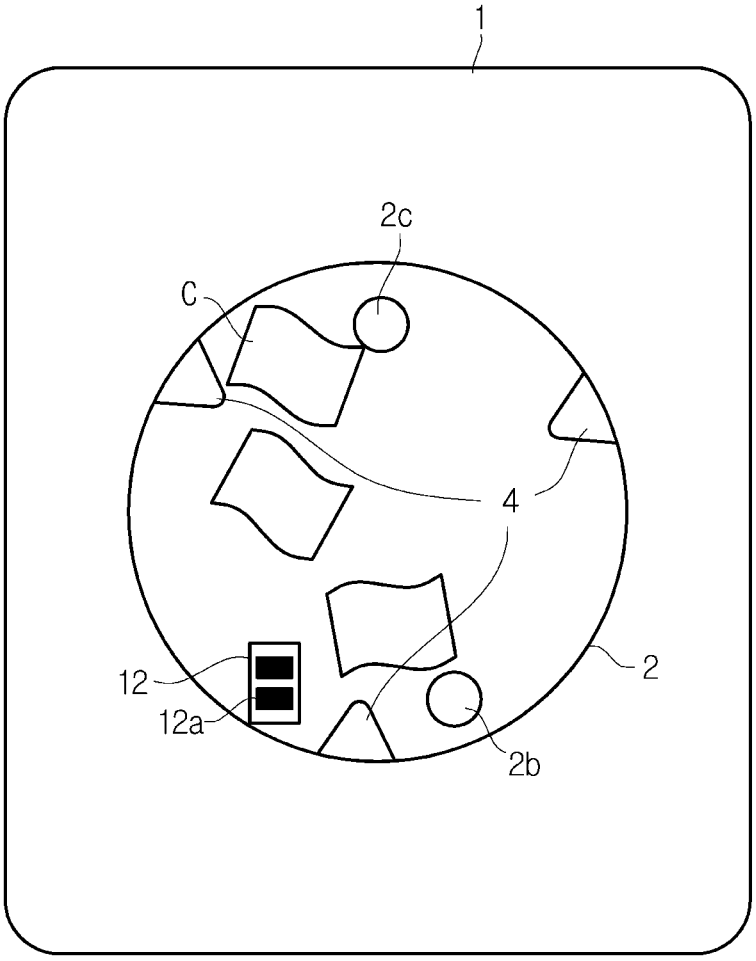
Figure 3:
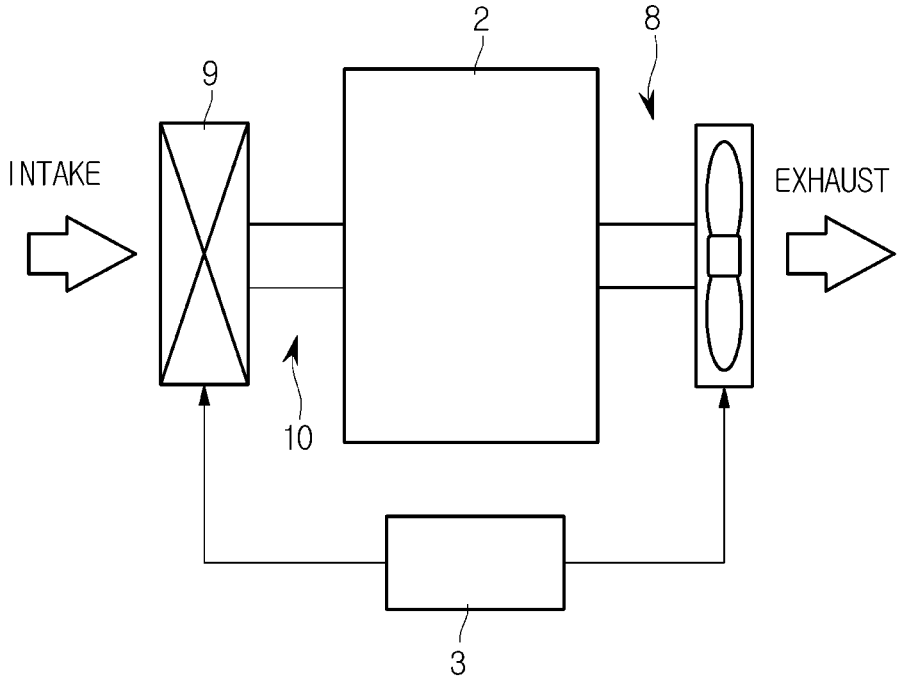
FIG. 3 is a mimetic diagram of a schematic configuration of a clothes dryer.

FIGS. 1 and 2 show schematic configuration of a clothes dryer in an embodiment: FIG. 1 is a side view, and FIG. 2 is a front view. FIG. 3 is a mimetic diagram of a schematic configuration of a clothes dryer.

In the embodiment, a clothes dryer D is an exhaust-type clothes dryer, including a housing 1 and a drum 2 rotatably supported in the housing 1.

At the front of the housing 1, an opening 1*a* in almost a circular form when viewed from the front is installed. The opening 1*a* may be opened or closed by a cover 13.

When the cover 13 is opened, an object to be dried C may be received in the drum 2 through the opening 1*a*.

An exhaust port 1*b* and an intake port 1*c* are installed at the back of the housing 1 to pass through the housing 1 in a direction from front to back or from back to front.

The drum 2 has the form of a cylinder with the bottom having a horizontal shaft origin connected to a motor 5 through a shaft 6 while facing the opening 1*a*.

In the drying operation of the clothes dryer D, the drum 2 is rotated around the shaft 6 (shaft origin) at a certain speed by driving the motor 5.

On the inner circumferential face of the drum 2, three baffles 4 extending in the direction of the rotation shaft origin are integrally and circumferentially installed in the drum 2 at equal intervals by protruding from the drum 2.

The number of baffles 4 is not limited to three, but may be e.g., two or four or more.

The clothes distributing means is not limited to the baffles 4.

Specifically, the clothes distributing means is configured to agitate clothes to distribute the clothes and may be operated independently from the drum 2.

In the drum 2, there may be an exhaust pipe 2*b* for exhausting dry air that was used for drying the object to be dried C from the drum 2 and an air vent nozzle 2*c* to introduce air to be used for drying the object to be dried C installed to pass through the drum 2 in the direction from front to back or back to front.

A gap between the air vent nozzle 2*c* and the intake port 1*c* of the housing 1 is connected by an introduction ventilation path 10, and a heater 9 for heating the air for drying is installed in the introduction ventilation path 10.

More specifically, the heater 9 is to heat the air introduced through the intake port 1*c* of the housing 1, and is switchable to e.g., three outputs: strong, weak, and off.

The heater 9 may also be switchable to more than three outputs

The exhaust pipe 2*b* and the exhaust port 1*b* of the housing 1 are connected by an exhaust ventilation path 8, and a fan device 7 for introducing air for drying into the drum 2 through the introduction ventilation path 10 is installed in the exhaust ventilation path 8.

More specifically, once a controller 3, which will be described later, drives the fan device 7, the air for drying in the drum 2 is exhausted out of the housing 1 from the exhaust pipe 2*b* of the drum 2 through the exhaust ventilation path 8 (fan device 7) and the exhaust port 1*b* of the housing 1.

Accordingly, the internal pressure of the drum 2 decreases and the air is introduced into the introduction ventilation path 10 from the intake port 1*c* of the housing. The air for drying heated by the heater 9 is then introduced into the drum 2 through the air vent nozzle 2*c* of the drum 2.

Positions where the heater 9 and fan device 7 are arranged are not limited to what are shown in FIG. 1.

Specifically, the fan device 7 and the heater 9 may each be installed at one of the exhaust ventilation path 8 or the introduction ventilation path 10.

For example, the fan device 7 may be installed in the introduction ventilation path 10, and the heater 9 may be installed in the exhaust ventilation path 8.

Instead of the heater 9, a (heat pump type) heat pump cycle may be used.

More specifically, the heat pump cycle may be comprised of a compressor (not shown), a condenser (not shown), and an evaporator (not shown), as a heating means equivalent to the heater 9.

Furthermore, instead of the heater 9, other heating means with variable output power may be used.

An electrode sensor 12 with a set of electrodes 12*a* (two electrodes are shown in FIG. 1) is arranged in the front lower part of the inner side of the drum 2 to make contact with clothes in the drum 2.

The electrode pair 12*a* is configured to have electric resistance changing according to contact or separation of the object to be dried C distributed by the baffles 4.

More specifically, when the drum 2 is rotated, the object to be dried C containing moisture is repeatedly lifted by a rising motion of the baffles 4 in the drum 2 and falls after reaching an upper part.

The electrode pair 12*a* is installed in a position where the falling object to be dried C makes contact and which is not rotated along with the drum 2.

In a case that the object to be dried C makes contact with the electrode pair 12*a*, a value of resistance becomes smaller as an amount of moisture contained increases.

Alternatively, the number of electrodes constituting the set of electrodes 12*a* is not limited to two but may be three or more. Alternatively, the electrode sensor 12 may include multiple electrode pairs.

The controller 3 for controlling at least the fan device 7 and heater 9 is installed at the top front part in the housing 1.

The controller 3 performs operation by setting a target output power of the heater 9 depending on the form of the object to be dried C.

More specifically, the controller 3 is a so-called computer equipped with a Central Processing Unit (CPU), a memory, analog-to-digital (A/D)/digital-to-analog (D/A) converters, input/output means, etc., and executes a program stored in the memory to coordinate the respective devices to carry out functions of at least a determiner 31, a storage 32, an information receiver 33, an output setter 34, an operation time setter 35, a pulse signal generator 36, a manipulation display 37.

Configuration and Drying Operation Control of Controller (1)

Figure 4:
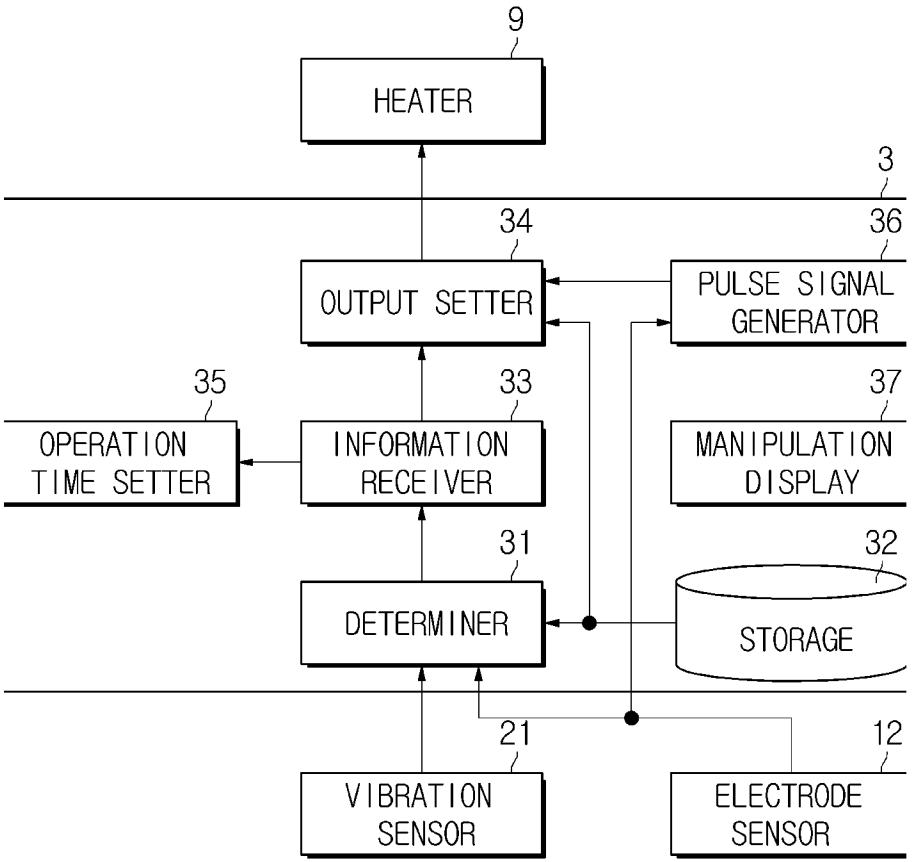
FIG. 4 is a control block diagram illustrating a controller according to an exemplary embodiment.

Components of the controller 3 will now be described in detail with reference to FIGS. 4 and 5.

The determiner 31 determines the size of the object to be dried C in the drum 2 based on a measurement of acceleration measured by a vibration sensor 21 installed in the housing 1 or drum 2 of the dryer D.

Figure 5:
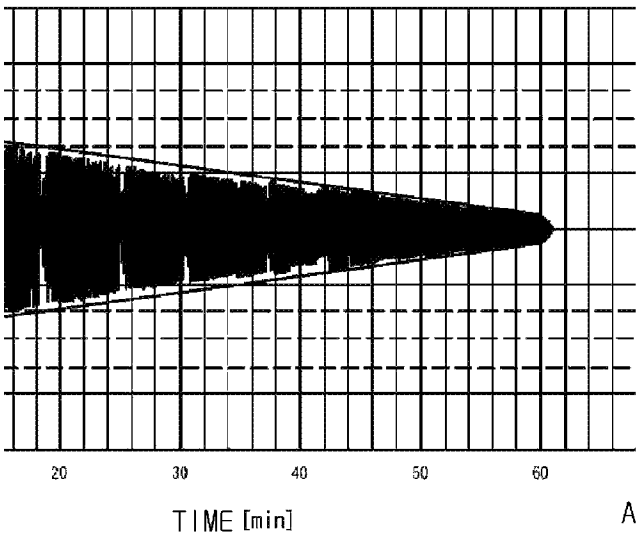
FIG. 5 is a graph showing the relationship between the amplitude of the acceleration measured by the vibration sensor and the size of the object to be dried according to an exemplary embodiment.

More specifically, as shown in the graph of FIG. 5, for a constant weight of the object to be dried C, the maximum amplitude of the acceleration measured by the vibration sensor 21 and the size of the object to be dried C are not correlated to each other.

Accordingly, correlations between the maximum amplitude of acceleration and the size of object to be dried C may be stored in the storage 32 in advance. The determiner 31 determines the size of the object to be dried C based on the correlations stored in the storage 32 and outputs the determined size information to the information receiver 33.

Table 1 represents relations between amplitudes of acceleration appearing for three minutes after the lapse of a certain period of time from the start of operation and sizes of object to be dried C contained in the drum 2.

The storage 32 may not store amplitudes of acceleration right after the start of drying operation but store relations between amplitudes of acceleration and sizes of the object to be dried C, as shown in Table 1.

TABLE 1

| Acceleration (m/s^2) | Size of object to be dried | Specific example of object to be dried |
|---|---|---|
| 4 or more | Large | Sheet, etc. |
| Equal to or greater than 3 to less than 4 | Normal | Shirt, etc. |
| Less than 3 | Small | Towel, etc. |

The determiner 31 determines the size of the object to be dried C corresponding to the maximum amplitude of acceleration measured by the vibration sensor 21 after the lapse of a certain period of time after the start of drying operation based on the measurement-size relations.

The determiner 31 outputs the determined size of the object to be dried C as size information to the information receiver 33.

The output setter 34 sets a target output power of the heater 9 per a unit time based on the condition of the object to be dried received by the information receiver 33.

More specifically, the output setter 34 may set a target output of the heater 9, which is proper for the size of the object to be dried C received by the information receiver 33 by referring to the size of the object to be dried C stored in the storage 32 and the size-output relations, which are relations between sizes of object to be dried C and target output set for the heater 9 according to the size.

The operation time setter 35 sets drying ending time of the heater 9 per a unit time based on the condition of the object to be dried C and output of the heater 9 received by the information receiver 33.

Here, the condition of the object to be dried C is not limited to any particular condition as long as the condition of the object to be dried C becomes a guidance for control of drying operation. For example, it indicates an extent of dryness, extent of entanglement, form, size, weight, amount of fabrics of the object to be dried C, etc.

Furthermore, the condition of the object to be dried C may be determined by measuring a value related to acceleration of the drum, a value related to vibration of the drum.

Apart from the correlations between the maximum amplitude of acceleration and size of the object to be dried C, the storage 32 may store size-output relations in which a lower output is set for the object to be dried C rather than one normally set if the object C is larger than a predetermined size.

In other words, the size-output relations may be set such that a first target output set when the size of the object to be dried C is larger than the predetermined size is smaller than a second target output set when the size of the object to be dried C is smaller than the predetermined size.

TABLE 2

| Size of object to be dried | Specific example of object to be dried | Target Output |
|---|---|---|
| Large | Sheet, etc. | Middle 1.5 kW (First Target Output) |
| Normal | Shirt, etc. | Large 5 kW (Second Target Output) |
| Small | Towel, etc. | Large 5 kW (Second Target Output) |

In the embodiment, the output setter 34 changes the target output for some of the drying operation period based on the size of the object to be dried C while setting the target output to be the same for the other period of time without following the size of the object to be dried C.

A specific example of setting the target output by the output setter 34 will be described with reference to the graph of FIG. 6.

Figure 6:
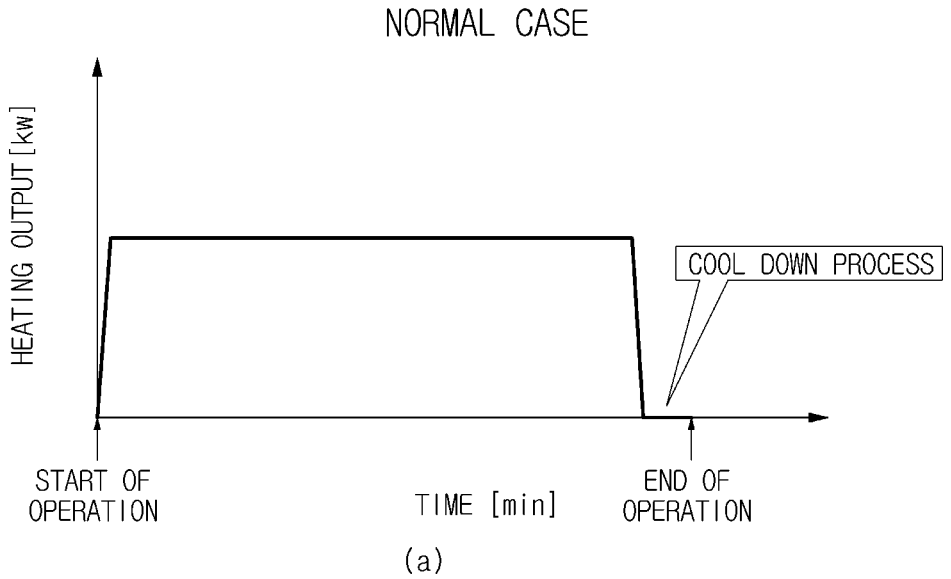
FIG. 6 is graph showing difference in setting the target output of the heater corresponding to a size of the object to be dried according to an exemplary embodiment.
Figure 6:
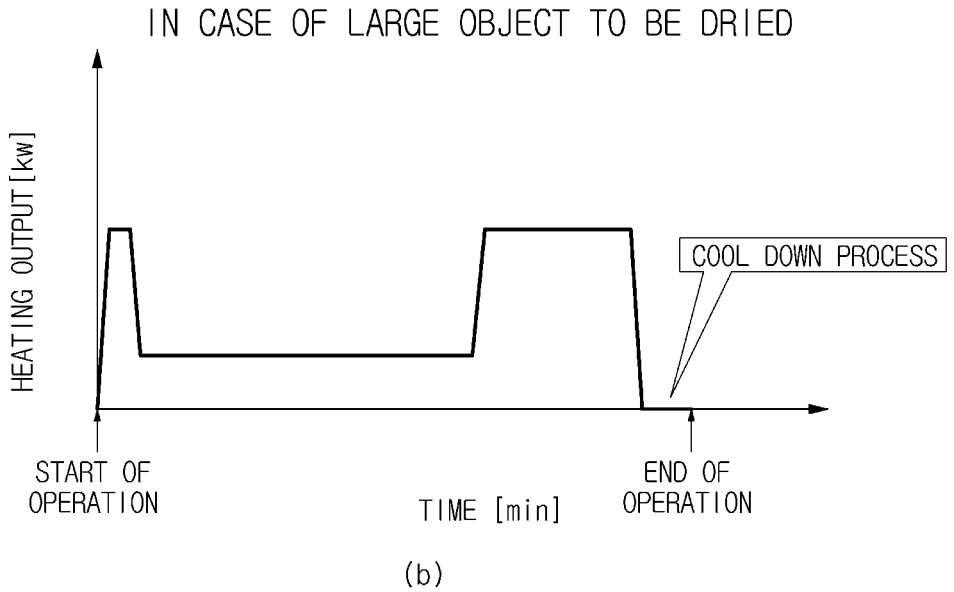

If the size of the object to be dried C received by the information receiver 33 is equal to or less than the size of a shirt, the output setter 34 sets a target output of the heater 9 to perform drying by maintaining large output from the start of operation to cool-down operation, as shown in the graph of FIG. 6 (*a*).

If the size information received by the information receiver 33 indicates more than a certain size, such as a sheet, the output setter 34 sets the target output to be less than normal for the most of drying operation period.

Setting the target output in this way prevents an effect that only the outer side of a lumpy object to be dried C in the drum 2 is dried while the inner side is not dried, but perfectly dries the object to be dried C by evenly heating the entire object to be dried C and extending the operation time as is normal.

Figure 7:
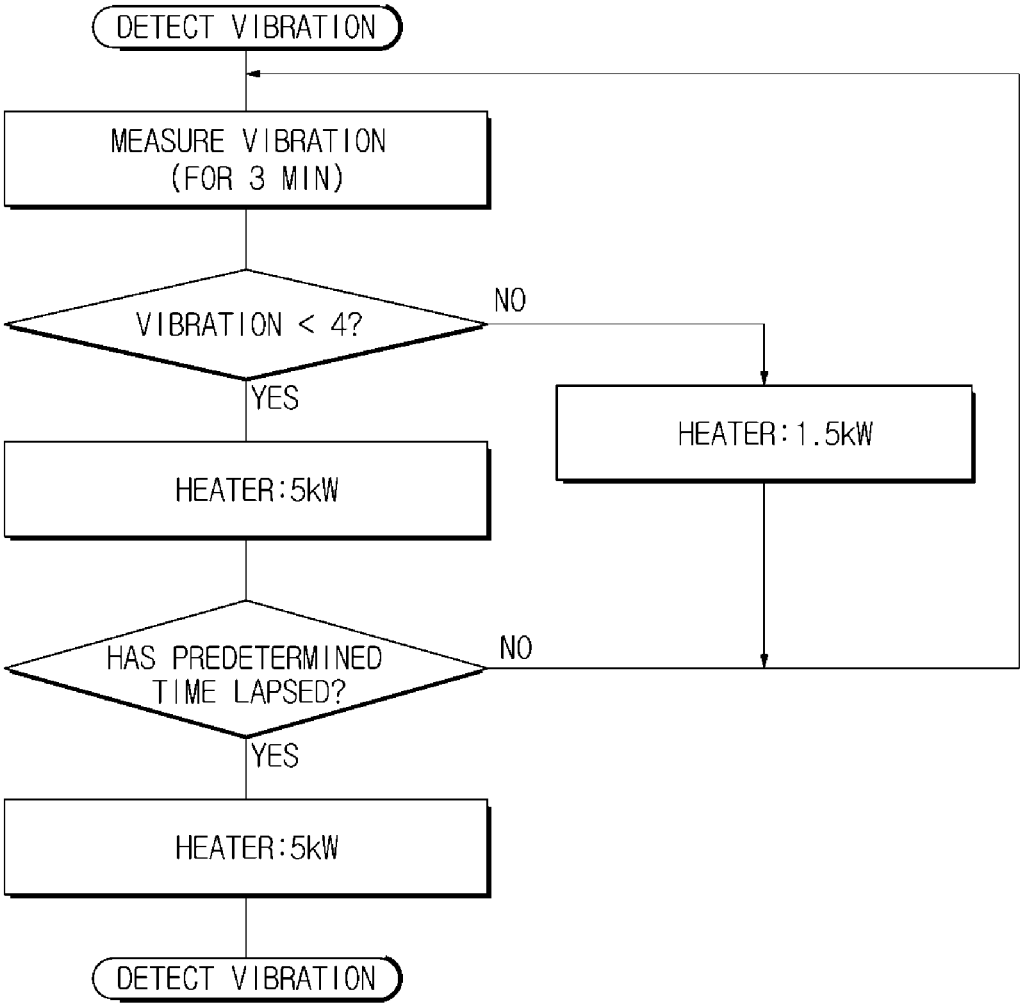
FIG. 7 is a flowchart of operation corresponding to setting the target output of the heater according to an exemplary embodiment.

A sequence of setting the target output of the heater 9 by the output setter 34 is the same as what is shown in the flowchart of FIG. 7.

The flowchart of FIG. 7 will be described briefly.

First, the dryer detects vibration of the drum.

The dryer measures vibration of the vibration sensor 21 for a predetermined time (about 3 minutes) after the laps of certain period of time from the start of drying operation, and determines the amplitude of measured acceleration.

Next, the dryer determines the size of the object to be dried C corresponding to the maximum amplitude of acceleration based on the measurement-size relations, and controls output of the heater based on the determined size of the object to be dried C.

A bit more specifically, the dryer determines that the size of the object to be dried is equal to or less than a predetermined size if the maximum amplitude of acceleration is less than 4, and maintains the output of the heater to be a predetermined output.

On the other hand, if the maximum amplitude of acceleration is equal to or greater than 4, the dryer determines that the size of the object to be dried is equal to or greater than the predetermined size and controls the output of the heater to be lower than the predetermined output.

Next, the dryer controls the output of the heater to be the predetermined output after the lapse of a certain period of time from the start of heater output control.

According to the dryer D in the embodiment as configured above, since the target output is changed according to the size of the object to be dried C, heating may be properly performed depending on the size of the object to be dried C.

Especially, since the target output is set to be less than normal target output in a case that the size of the object to be dried C is larger than the predetermined size, such as in a case of a shirt, the dryer D in the embodiment may evenly dry the object to be dried by reducing the output of the heater 9 below a predetermined output unlike the conventional dryer that dries only the outer side of a lumpy sheet from rapid heating but not sufficiently dries the inner side, causing uneven dryness.

Accordingly, even for a large object to be dried C like the sheet, the object to be dried may be completely dried at reduced power consumption for the same drying operation time as for the object to be dried C having a size equal to or smaller than normal.

The sequence of setting the target output of the heater 9 by the output setter 34 is not limited to the flowchart of FIG. 7.

Figure 8:
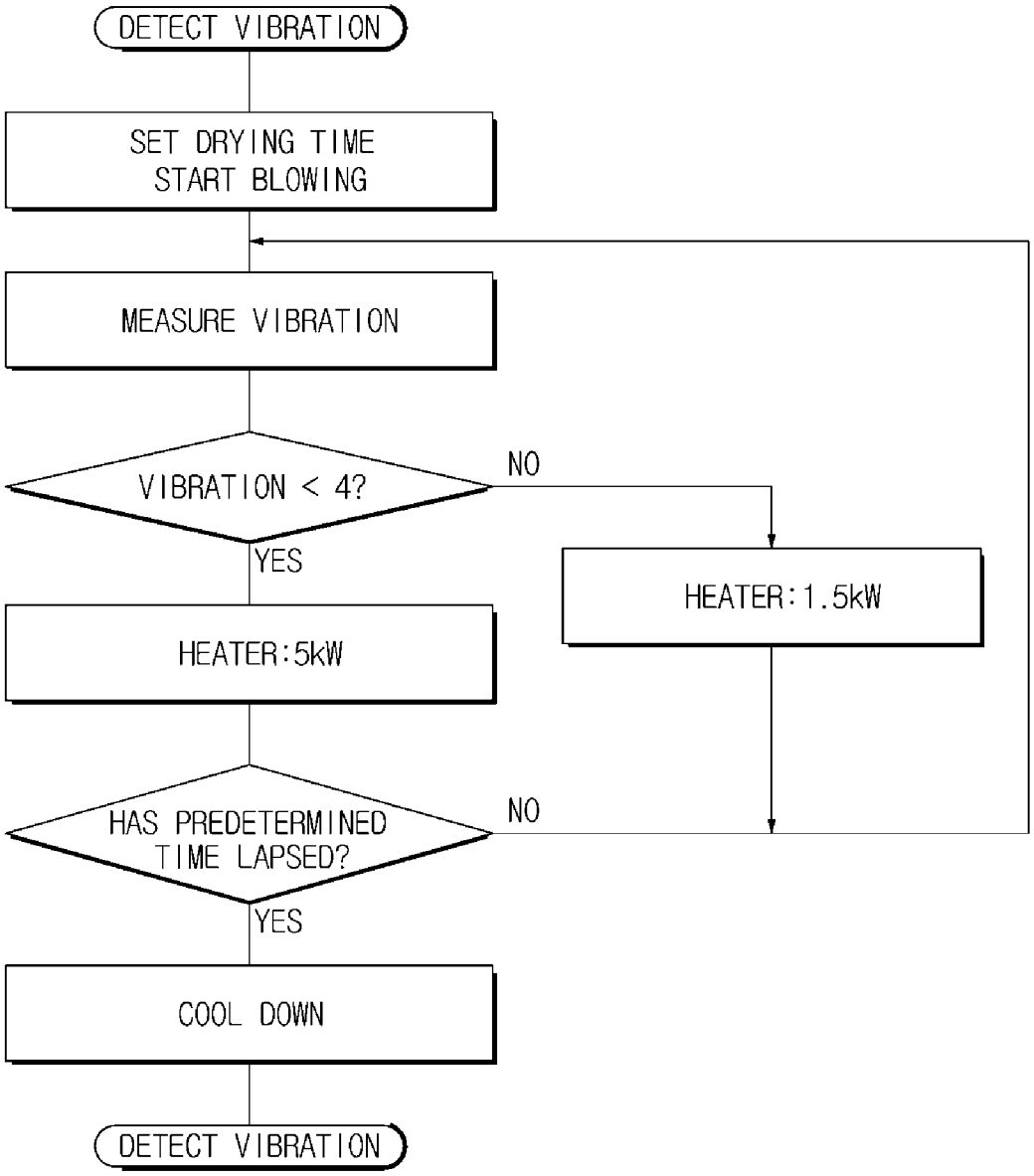
FIG. 8 is a flowchart of operation corresponding to setting the target output of the heater according to an exemplary embodiment.

For example, as shown in the flowchart of FIG. 8, the output setter 34 may be configured to maintain a different target output for each size of the object to be dried C for the most of drying operation time.

The flowchart of FIG. 8 will now be briefly described.

First, once a drying operation command is input, the dryer sets drying time and starts blowing.

Next, the dryer detects vibration of the drum.

The dryer measures vibration of the vibration sensor 21 for a predetermined time (about 3 minutes) after the laps of certain period of time from the start of drying operation, and determines the amplitude of measured acceleration.

Next, the dryer determines the size of the object to be dried C corresponding to the maximum amplitude of acceleration based on the measurement-size relations, and controls output of the heater based on the determined size of the object to be dried C.

A bit more specifically, the dryer determines that the size of the object to be dried is equal to or less than a predetermined size if the maximum amplitude of acceleration is less than 4, and maintains the output of the heater to be a predetermined output.

On the other hand, if the maximum amplitude of acceleration is equal to or greater than 4, the dryer determines that the size of the object to be dried is equal to or greater than the predetermined size and controls the output of the heater to be lower than the predetermined output.

Next, if it is an ending time of the drying time, the dryer controls cool-down and stops drying operation once the cool-down is completed.

As for the measurement-size relations, it is also possible to set relations between abnormal vibrations indicating that the object to be dried C is in an abnormal motion state or abnormally bundled state and amplitudes of acceleration in addition to the relations between the size of the object to be dried C and the maximum amplitude of acceleration.

Figure 9:
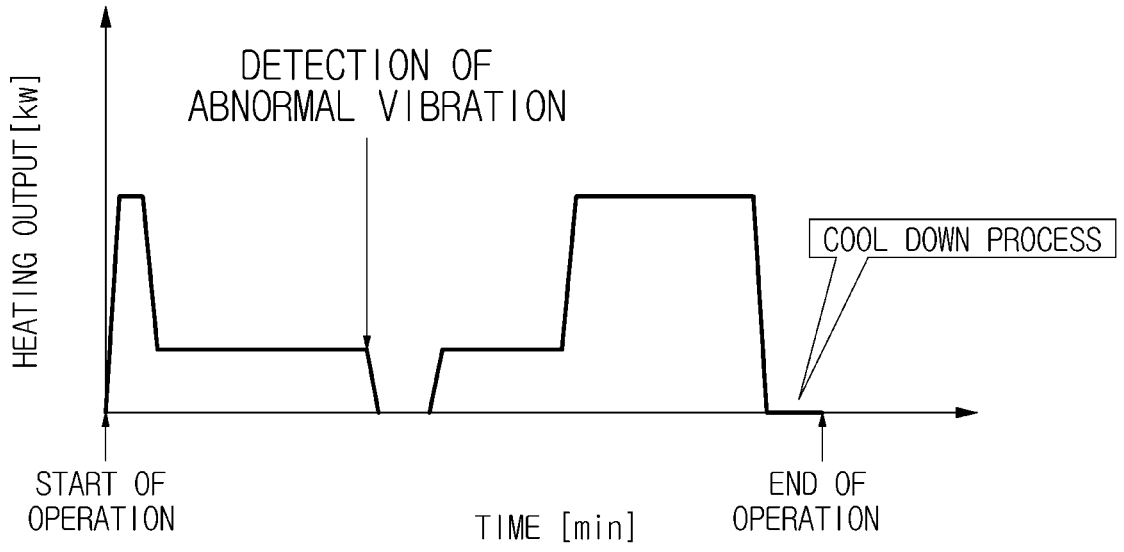
FIG. 9 is a time chart showing an example of a change in the target output to be set.

If the determiner 31 determines that the abnormal vibration has occurred, the output setter 34 may stop operation of the heater 9 by setting the target output to zero for a certain period of time from when the abnormal vibration has been detected, as shown in the graph of FIG. 9.

By doing this, even if the object to be dried C is bundled into a big mass in the drum 2, it may be heated sufficiently and may prevent just the outer side of the object to be dried C from being excessively heated and burnt, thereby further increasing safety.

Figure 10:
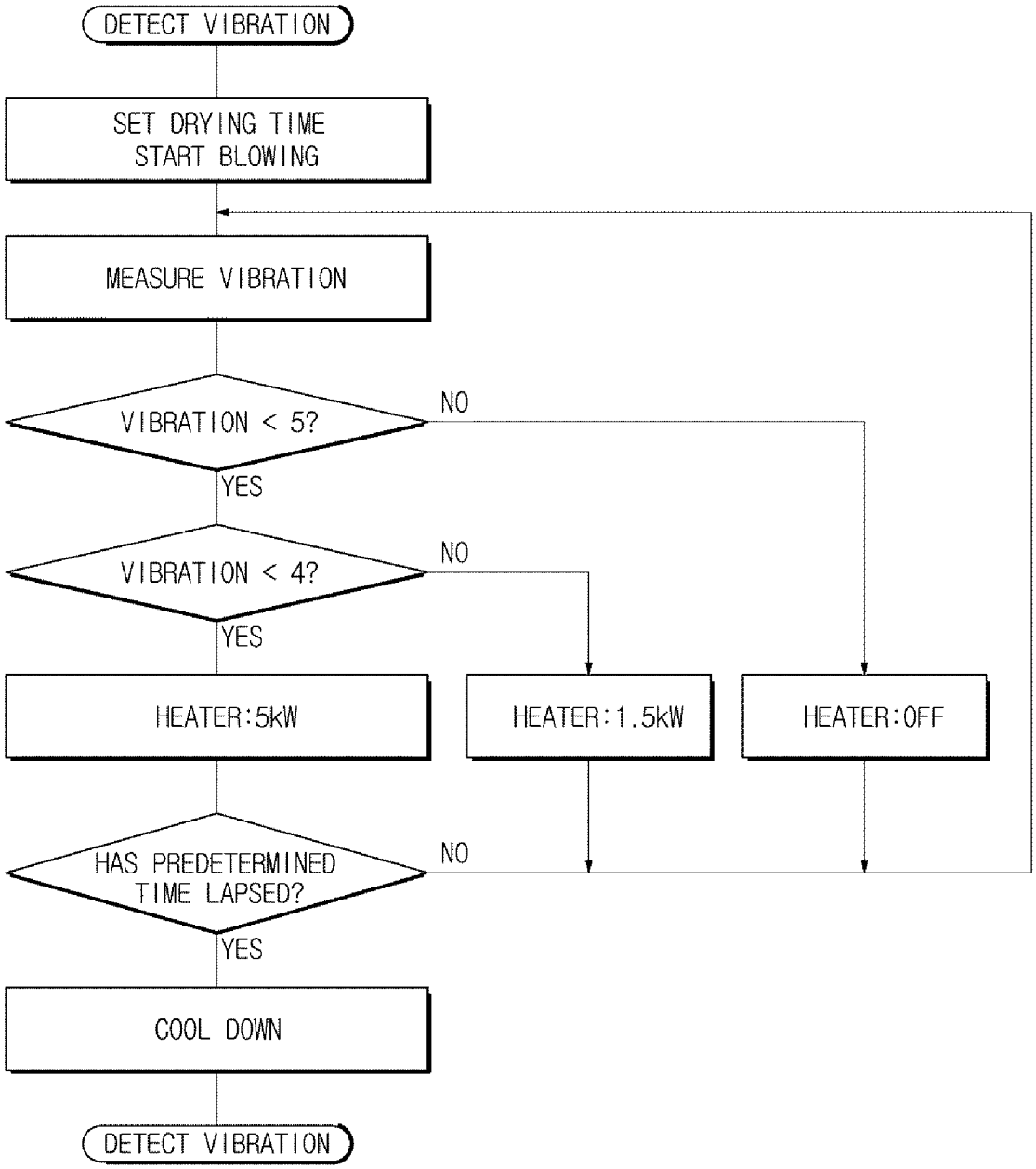
FIG. 10 is a flowchart of operation corresponding to setting the target output of the heater according to an exemplary embodiment.

In the modified embodiment, operation of the output setter 34 is the same as what is shown in the flowchart of FIG. 10.

The flowchart of FIG. 10 will now be briefly described.

First, once a drying operation command is input, the dryer sets drying time and starts blowing.

First, the dryer measures vibration of the drum.

The dryer measures vibration of the vibration sensor 21 for a predetermined time after the laps of a certain period of time from the start of drying operation, and determines the amplitude of measured acceleration.

Next, the dryer determines the size of the object to be dried C corresponding to the maximum amplitude of acceleration based on the measurement-size relations, and controls output of the heater based on the determined size of the object to be dried C.

A bit more specifically, the dryer determines that the size of the object to be dried is equal to or less than a predetermined size if the maximum amplitude of acceleration is less than 4, and maintains the output of the heater to be a predetermined output.

If the maximum amplitude of acceleration is equal to or greater than 4 and less than 5, the dryer determines that the size of the object to be dried is equal to or greater than the predetermined size and controls the output of the heater to be lower than the predetermined output.

The dryer determines that vibration has occurred if the maximum amplitude of acceleration is equal to or greater than 5, and controls the heater to be off.

Next, if it is an ending time of the drying time, the dryer controls cool-down operation and stops drying operation once the cool-down operation is completed.

Configuration and Drying Operation Control of Controller (2)

Another example of configuration of the controller will now be described.

Description of the embodiment will focus on parts different from the "Configuration and Drying Operation Control of controller (1)".

More specifically, the embodiment is different from the previous embodiment in that a sensor used to determine the size of the object to be dried C is not the vibration sensor 21 but the electrode sensor 12.

The storage 32 stores measurement (conduction frequency)—size relations, which are relations between the number of conduction times in a unit time as measurements measured by the electrode sensor 12, and the size of the object to be dried C.

The determiner 31 determines the size of the object to be dried C based on the number of times of conduction of resistance measured by the electrode sensor 12 in a unit time, i.e., the number of times of contacts between the object to be dried C and the electrode sensor 12 in the unit time, based on the measurement-size relations, and outputs the size information to the information receiver 33.

More specifically, in the embodiment, sampling is done 20 times in a second, a maximum or minimum value of contact times in a second at every minute is obtained, and the size of the object to be dried C is determined based on the maximum or minimum value.

Characteristic configuration of the other components is in common with "Configuration and Drying Operation Control of controller (1)".

Figure 11:
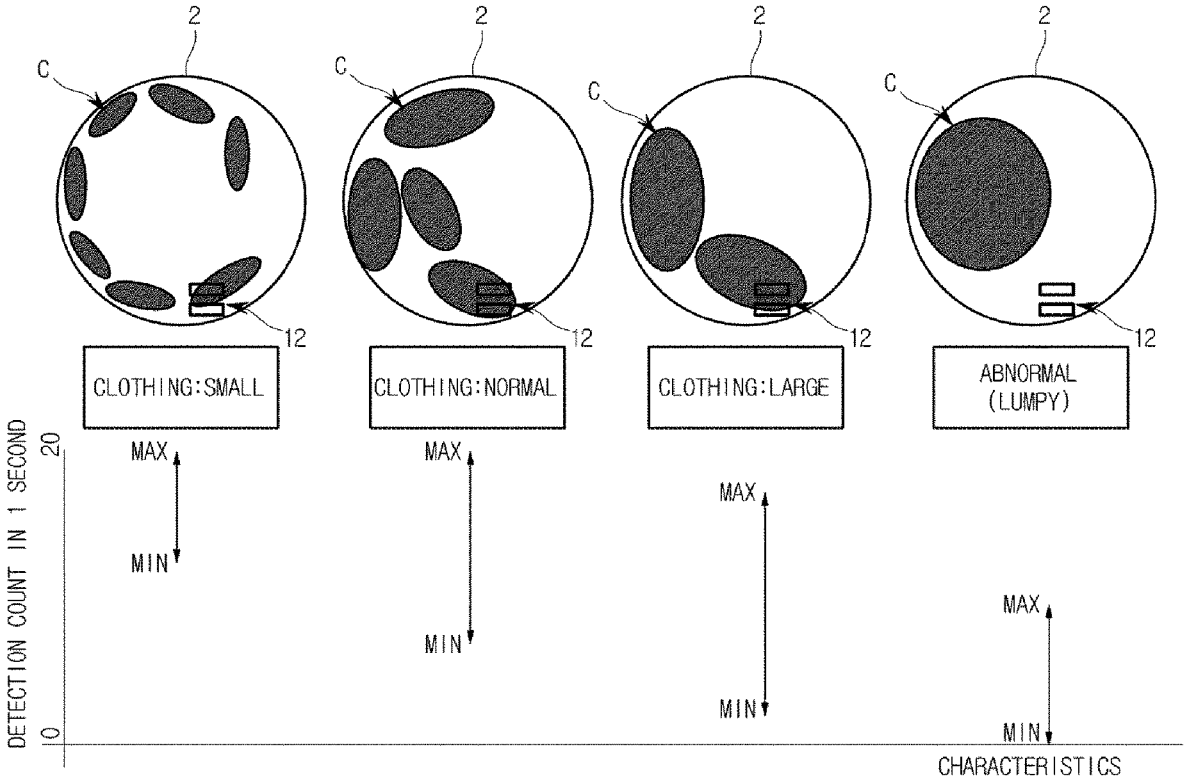
FIG. 11 is a schematic diagram showing the relationship between the number of contact per unit time measured by the electrode sensor and the size of the object to be dried.

Here, if the rotation speed of the drum 2 is constant and the position of the object to be dried C in the drum 2 is stable, the smaller the object to be dried C, the higher the frequency of contact with the electrode sensor 12 per unit time, as shown in the mimetic diagram and graph of FIG. 11.

This means that in a case that the object to be dried C is comprised of e.g., many small towels, the electrode sensor 12 and the object to be dried C almost always contact with each other as the object to be dried C is circumferentially present in the drum 2 almost without a gap.

On the other hand, since the larger the object to be dried C is as is a sheet, the easier the object to be dried C is lopsided, it is likely to have an area formed at locations with the same diameter on a concentric circle of the electrode sensor 12.

This makes a tendency that the larger the object to be dried C, the lower the frequency of contact with the electrode sensor 12. The storage 32 stores the measurement-size relations based on the tendency, as the following table e.g., shown in FIG. 3.

TABLE 3

| Determination condition | Size of object to be dried | Specific example of object to be dried |
|---|---|---|
| All minimum values are less than 1 | Abnormal state | Lump made |
| other condition | Large (uneven in the drum) | Sheet, etc. |
| There is a maximum value of 20 | Normal | Shirt, etc. |
| All maximum values are more than 19 | Small (even in the drum) | Towel, etc. |

Figure 12:
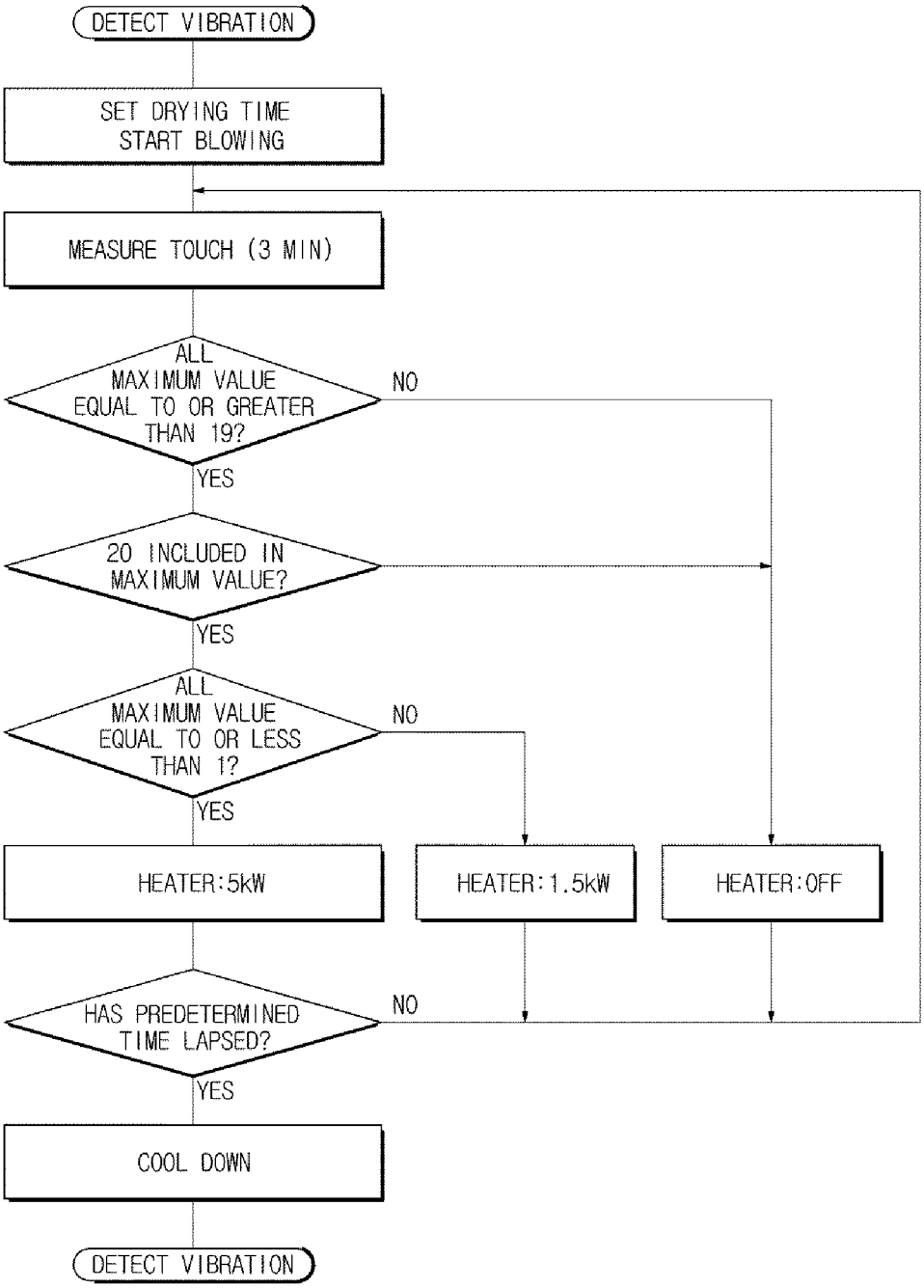
FIG. 12 is a flowchart of operation corresponding to setting the target output of the heater according to an exemplary embodiment.

If the above measurement-size relations are set, the output setter 34 may set a target output of the heater 9 in the same sequence as in e.g., the flowchart shown in FIG. 12.

The flowchart of FIG. 12 will now be briefly described.

First, once a drying operation command is input, the dryer sets drying time and starts blowing.

Next, the dryer measures contacts (i.e., touches) of the electrode sensor for a predetermined time after the lapse of a certain period of time from the start of drying operation.

The dryer performs sampling 20 times in a second, obtains a maximum or minimum value of contact times in a second at every minute, and determines the size of the object to be dried C based on the maximum or minimum value.

The dryer determines that the object to be dried is small if all the maximum values are equal to or more than 19 or the maximum values include 20, and keeps the output of the heater at a predetermined output.

On the other hand, the dryer controls the output of the heater to be lower than the predetermined output if all the minimum values are not equal to or less than 1, and controls the output of the heater to be off if all the minimum values are equal to or less than 1.

Next, if a certain period of time has lapsed from the start of output control of the heater, the dryer performs cool-down and stops drying operation if the cool-down has been completed.

As such, even with the dryer D in the other embodiment, the size of the object to be dried C may be determined based on a measurement by the electrode sensor 12.

Furthermore, similar to the dryer D with "Configuration and Drying Operation Control of controller (1)", since the target output set for the heater 9 is changed according to the determined size of the object to be dried C, power saving and sufficient drying may be compatibly achieved.

Especially, since for a large object to be dried C, the target output is set to be smaller than normal, the large sized object to be dried C may be heated slowly to prevent drying only outer side but inner side and waste of energy for heating.

Furthermore, a condition for determining the size of the object to be dried C is not limited to what is described above, but may be set properly to show correlations with various contact frequencies.

For example, the size of the object to be dried C may be determined based on the average of maximum and minimum values of contact times within three-minute measurement or based only on times of contact per second.

It is also possible to set a time to end the drying operation based on the extent of drying progress based on an occasion where contact frequency of the electrode sensor 12 with the object to be dried C is less than a certain value.

Configuration of Controller (3)

Another example of configuration of the controller will now be described.

Description of "Configuration and Drying Operation Control of controller (1)" of another embodiment will focus on parts different from the previous embodiments.

A pulse signal generator 36 is connected to the electrode pair 12*a* of the electrode sensor 12 and converts a change in resistance between the electrode pair 12*a* when the object to be dried C containing moisture repeats making contact with and separation from the electrode pair 12*a* (electrode sensor 12) into a pulse signal.

More specifically, the pulse signal generator 36 outputs the pulse signal if the electric resistance of the electrode pair 12*a* involving in contact with the object to be dried C containing moisture is less than a certain threshold and outputs no pulse signal if the electric resistance of the electrode pair 12*a* exceeds the threshold.

In other words, the pulse signal generator 36 outputs a pulse signal from contact of the object to be dried C with the electrode pair 12*a* if the object to be dried C has low dryness (has lots of moisture) and outputs no pulse signal even from the contact of the object to be dried C with the electrode pair 12*a* if the object to be dried C has high dryness (has low moisture).

The manipulation display 37 includes a manipulator and a display, which are not shown.

The manipulator receives various manipulation inputs from the user.

The display displays a manipulation situation of the manipulator by the user or a drying operation situation (e.g., progress state or error).

The controller 3 performs various control, such as motor driving control, and operation control of the fan device 7 or heater 9, based on the pulse signal output from the pulse signal generator 36, predetermined drying operation condition, the user's manipulation on the manipulator, etc.

Furthermore, the clothes dryer D includes a first temperature measuring means 15 installed between the intake port 1*c* of the housing 1 and the heater 9 for detecting the temperature of air introduced from outside, a second temperature measuring means 16 installed between the heater 9 and the air vent nozzle 2*c* of the drum 2 for detecting the temperature of air heated by the heater 9, and a third temperature measuring means 17 installed between the exhaust pipe 2*b* of the drum 2 and the fan device 7 for detecting the temperature of air for drying exhausted from the inside of the drum 2.

Moreover, a non-conduction period is set for the heater 9 at the beginning of drying operation, and during the period, the temperature of the air introduced from outside of the housing 1 is detected using one of the temperature measuring means 15, 16, 17.

In addition, the temperature measuring means may measure a surrounding temperature or a temperature of the air for drying introduced into the introduction ventilation path 10 or exhaust ventilation path 8 from the outside of the clothes dryer D.

There are no limitations on positions or configuration of the temperature measuring means.

Difference in Drying Characteristics Depending on Texture and Form of Clothing

Figure 14:
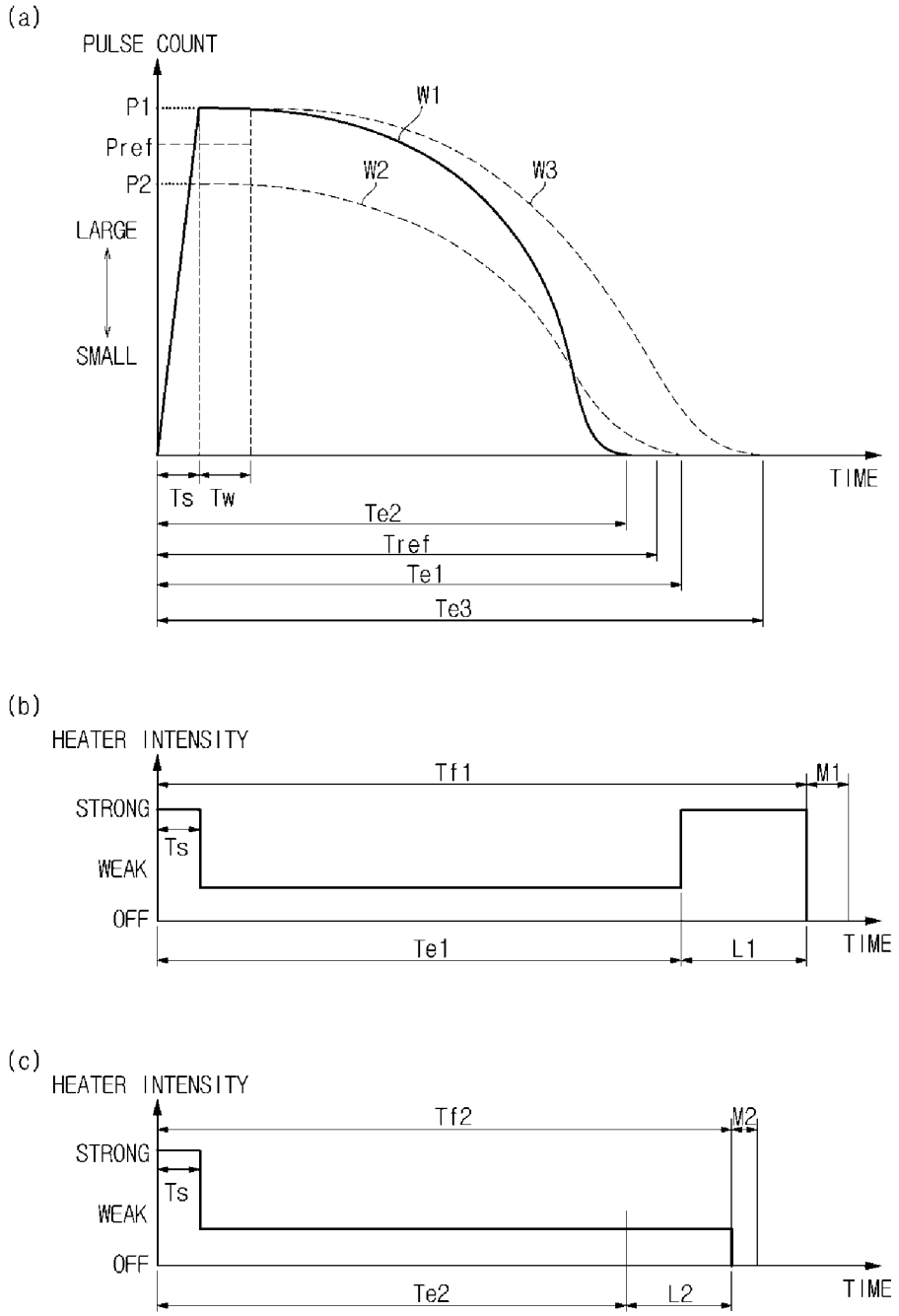
FIG. 14 (*a*) shows relations between drying operation time and integration of pulse signal count per unit time according to an exemplary embodiment.

FIG. 14 (*a*) shows relations between drying operation time and integration of pulse signal count per unit time in the present invention.

In FIG. 14 (*a*), "W1" indicates an example of drying characteristics in a case that the object to be dried C has a uniform small towel form and contains chemical fabrics more than a certain level, "W2" indicates another example of drying characteristics in a case that the object to be dried C has a mix of various forms of clothes, such as a large sheet or bath towel, jeans, etc., and "W3" indicates another example of drying characteristics in a case that the object to be dried C has a lot of clothes with non-uniform forms or has small uniform form of towels and contains cotton fabrics.

Assume that the volumes of the objects to be dried C of "W1" and "W2" are the same.

Figure 16:
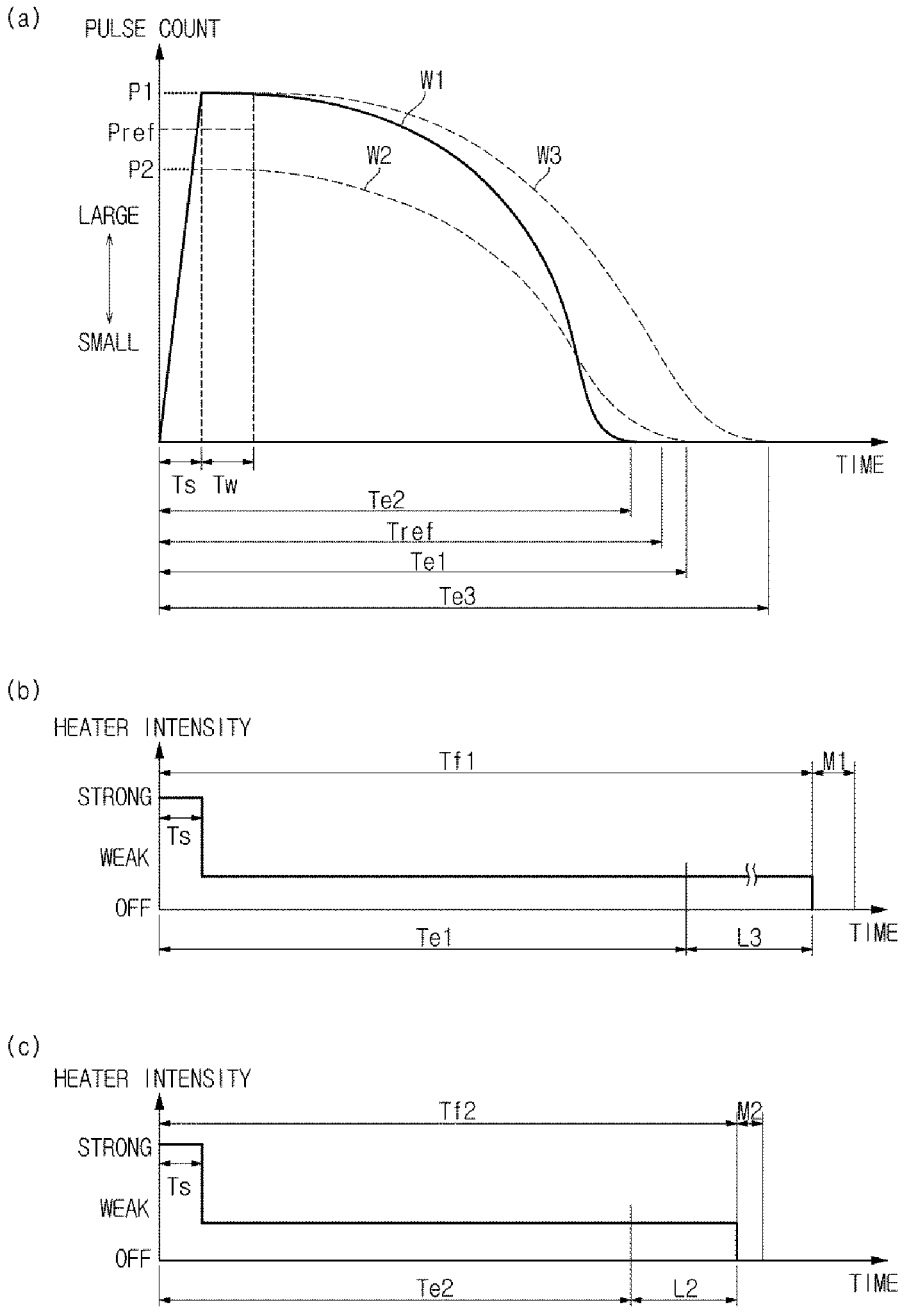
FIG. 16A is a diagram showing the relationship between the drying operation time and the integrated value of the number of pulse signals per unit time.
FIGS. 16B and 16C show an example of the heater control based on the flowchart of FIG. 15.
Figure 17:
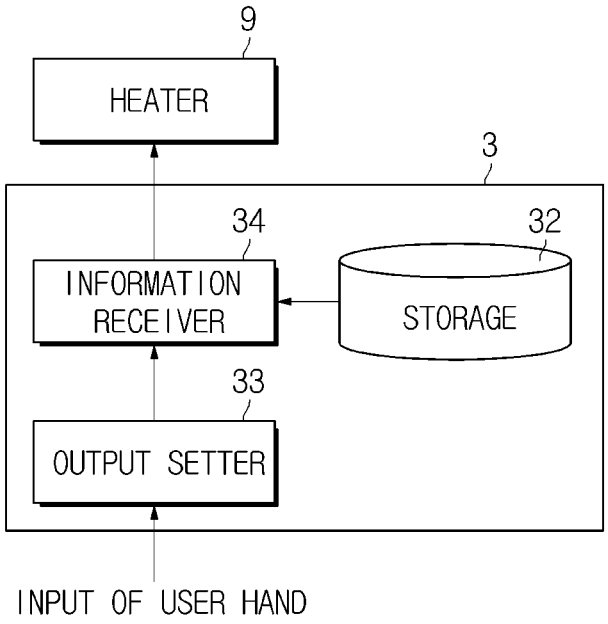
FIG. 17 is a control block diagram illustrating a controller according to an exemplary embodiment.

The same goes for the following FIG. 16 (*a*).

Like W1, W2, and W3 of FIG. 14 (*a*), the object to be dried C is commonly wet and contains lots of moisture at the beginning stage of a drying process after the start of drying operation, so the electric resistance is small and the integration of pulse signal count P per unit time (hereinafter, simply referred to as integration of pulse signal count P) is high (for example, refer to time Tw of FIG. 14 (*a*)).

As the drying process progresses, the object to be dried C is slowly dried to reduce the amount of moisture contained, so the electric resistance increases and the integration of pulse signal count P gradually decreases accordingly.

As shown in W1 of FIG. 14 (*a*), if the object to be dried C is small and has a lot of uniformly shaped ones, when the drum 2 is rotated at a certain rpm, the object to be dried C is repeatedly lifted by the baffles 4 and falls from a certain position in a stable way, so the integration of pulse signal count P tends to increase compared with an occasion where the object to be dried C is a mix of various forms.

On the other hand, as shown in W2 of FIG. 14 (*a*), in a case of a mix of various forms of clothes, such as a large sheet or bath towel, jeans, etc., behavior of the clothing is not stage due to entanglement or overbalance while the drum 2 is being rotated, so the frequency of contact of the object to be dried C with the electrode pair 12*a* decreases and the integration of pulse signal count P decreases with a constant volume of the object to be dried C compared with an occasion where the object is small and has a lot of uniformly shaped ones.

In the case of drying the object to be dried C, even if the integration of pulse signal count P is '0', for example, uneven drying is likely to occur, so after the integration of pulse signal count P becomes '0', it is not possible to reduce output power of the heater 9 or shorten the drying operation time.

As shown in W3 of FIG. 14 (*a*), even in the case of a mix of various forms of clothes, if the amount of the object to be dried C increases, the integration of pulse signal count P at the beginning stage of the drying process after the start of drying operation increases but some time and energy is required to proceed the drying course, thereby leading to increased operating time Te3 before detection of dryness, which is the time until the integration of pulse signal count P becomes '0'.

Drying Operation Control of Controller (3)

Next, drying operation of the clothes dryer D will be described in detail based on the flowchart of FIG. 13 and relations between drying operation time and pulse signal count of FIG. 14.

First, once the drying operation begins by inserting the object to be dried C having moisture to the clothes dryer D, the controller 3 sets the output of the heater 9 to 'strong' (hereinafter, referred to as setting high heating mode) during a certain period of time Ts (e.g., during several minutes) from the start of the drying operation, in S100.

Performing the beginning of the drying operation with 'strong' output of the heater 9 may enable the object to be dried C to be easily distributed when the object to be dried C is agitated in the drum 2.

After the lapse of predetermined time Ts, the controller 3 sets the output of the heater 9 to 'weak' (hereinafter, referred to as 'weak heating mode').

The controller 3 starts integrating pulse count of a pulse signal output from the pulse signal generator 36, and stores the integration of pulse signal count Pw during the lapse of a predetermined period of time Tw (e.g., during several minutes) after the heating mode is set to weak, i.e., during the predetermined period of time Tw after the lapse of the predetermined time Ts, in S101.

After that, the controller 3 keeps checking the integration of pulse signal count P per the certain period of time Tw until the integration of pulse signal count P per the certain time (unit time) Tw is '0' several times in a row (e.g., two times).

When the integration of pulse signal count P has been '0' several times in a row (yes in S102), the controller 3 controls the subsequent drying operation based on whether the operating time Te before detection of dryness, which is a drying operation time at when the integration P is '0', is less than a predetermined reference time Tref and whether the integration of pulse signal count Pw stored in S101 exceeds a predetermined integration reference value Pref.

The unit time (predetermined time) to obtain the integration of pulse signal count P is not limited to Tw but may be set arbitrarily.

Alternatively, as the operating time before detection of dryness, time during which the integration of pulse signal count P is below a certain threshold other than '0' several times in a row may also be used.

Specifically, if the operation time before detection of dryness Te is less than the predetermined reference time Tref and the integration of pulse signal count Pw exceeds Pref, i.e., if the object to be dried C satisfies a uniform clothing condition as the second condition to determine that the object to be dried C has a uniform form (e.g., small towel form) and contains lots of chemical fabrics ('yes' in S103), the controller 3 continues drying operation with the output power of the heater 9 set to 'weak' in S104.

In the example of FIG. 14 (*c*), the operation time before detection of dryness is Te2, and after the end of the operation time Te2, drying operation is continued with the output power of the heater 9 set to 'weak'. During the drying operation period in S104, the controller 3 may control the fan device 7 to have increased intensity. This may reduce cooling time as will be described later.

If execution time of the drying operation after the operation time before detection of dryness (Te2 in FIG. 14 (*c*)) is execution time for a predetermined uniform clothing condition (L2 in FIG. 14 (*c*)) (yes in S105), the controller 3 sets the output of the heater 9 to 'off' and switches to cooling control to continue the operation of the fan device 7, in S106.

After the laps of cooling time M2 for the predetermined uniform clothing condition, the controller 3 stops the drying operation. The cooling time M2 for the uniform clothing condition is set to be shorter than cooling time M3 for a normal condition as will be described below. This may enable energy saving drying operation. On the other hand, if the operation time before detection of dryness is longer than the predetermined reference time Tref or if the integration of pulse signal count Pw is less than Pref, i.e., if the normal condition as the first condition to determine that the portion of the object to be dried C with high drying efficiency is not high is not satisfied (no in S103), the controller 3 sets the output power of the heater 9 to 'strong', in S111. In the example of FIG. 14 (*b*), the operation time before detection of dryness is Te1, and after the end of the operation time Te1, the output power of the heater 9 is changed to 'strong'.

If execution time of the drying operation after the operation time before detection of dryness (Te1 in FIG. 14 (*b*)) is execution time L1 for the predetermined uniform clothing condition (yes in S112), the controller 3 sets the output of the heater 9 to 'off' and switches to cooling control to strengthen and continue the operation of the fan device 7, in S113.

After the laps of cooling time M1 for the predetermined normal condition, the controller 3 stops the drying operation.

According to the another embodiment, if the uniform clothing condition is satisfied, the controller 3 of the clothes dryer D determines that energy saving operation is possible because the clothing to be dried has many clothes in uniform form (e.g., small towel form) and containing lots of chemical fabrics, and thus sets the heating intensity of the heater 9 to a weak heating mode for drying operation after the operation time before detection of dryness (first operation period).

That is, it may ensure to prevent damage or shrinkage of fabrics due to excessive dryness or high temperature and to perform energy saving drying operation.

On the other hand, the controller 3 sets the heating intensity of the heater into the strong heating mode if the normal condition is satisfied.

Thus, it may surely prevent non-dryness or uneven dryness of the clothing.

Accordingly, it may perform drying operation with efficiently saved energy depending on a combination of forms or types of clothing to be dried while preventing non-dryness or uneven dryness and damage or shrinkage of fabrics due to excessive drying or high temperature.

Drying Operation Control of Controller (4)

Figure 15:
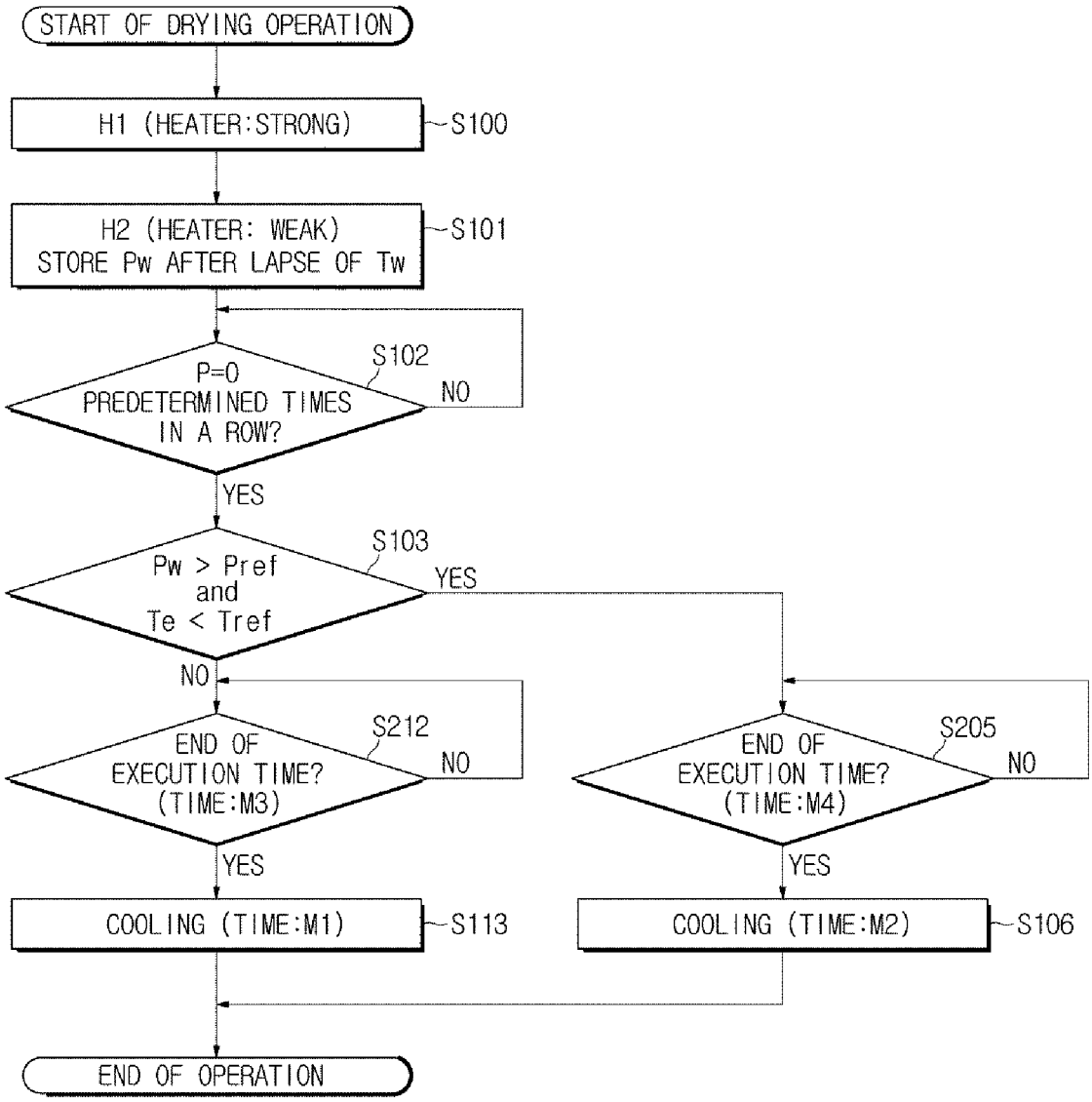
FIG. 15 is a flowchart representing another example of controlling drying operation.

FIG. 15 is a flowchart representing another example of controlling drying operation. Furthermore, configuration of the controller is in common with "configuration of controller (3)".

Figure 13:
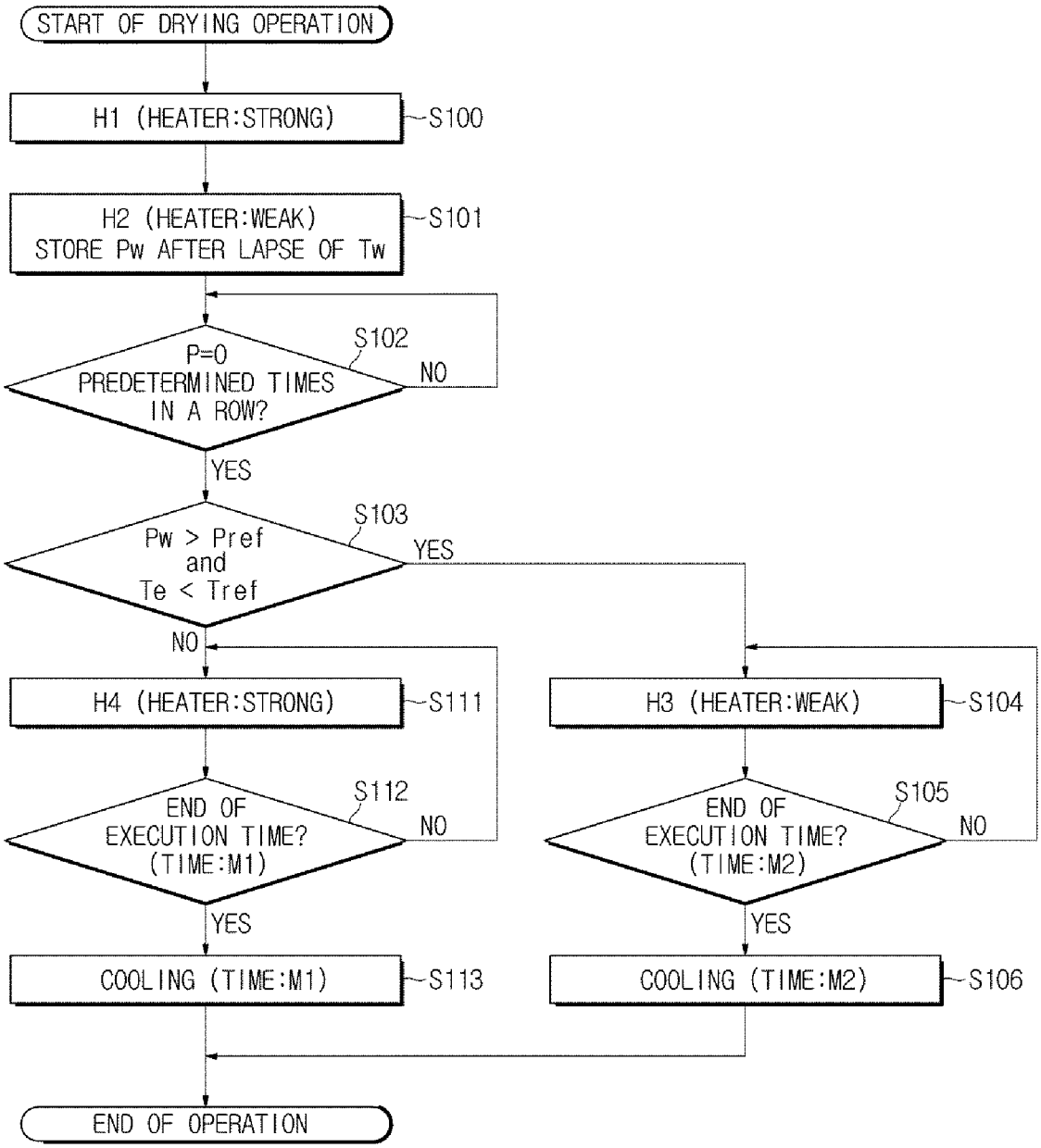
FIG. 13 is a flowchart showing an operation of a dryer during the drying operation according to an exemplary embodiment.

In FIG. 15, steps S100 to S102 are in common with FIG. 13, so the description thereof will be omitted herein.

In S103 of FIG. 15, if the operation time before detection of dryness Te is less than the predetermined reference time Tref and the integration of pulse signal count Pw exceeds Pref, i.e., if the uniform clothing condition is satisfied (yes in S103), the controller 3 continues drying operation until the execution time of drying operation after the operation time before detection of dryness reaches execution time for the predetermined uniform clothing condition.

During the drying operation period after S103, the controller 3 may control the fan device 7 to have increased intensity. This may reduce cooling time as will be described later.

If execution time of the drying operation after the operation time before detection of dryness is execution time for the predetermined uniform clothing condition (yes in S205), the controller 3 sets the output of the heater 9 to 'off' and switches to cooling control to continue the operation of the fan device 7, in S106. After the laps of cooling time M2 for the predetermined uniform clothing condition, the controller 3 stops the drying operation.

In the example of FIG. 16 (*c*), the operation time before detection of dryness is Te2, and the controller 3 continues to operate the heater 9 with 'weak' setting until the execution time L4 is lapsed even after the lapse of the operation time before detection of dryness Te2, and then changes the setting of the heater 9 to be 'off'.

In S103 of FIG. 15, if the operation time before detection of dryness Te is longer than the predetermined reference time Tref or the integration of pulse signal count Pw is less than Pref, i.e., if the normal condition to determine that a portion of the object to be dried C with high drying efficiency is not high is satisfied (no in S103), the controller 3 continues drying operation until the execution time of drying operation after the operation time before detection of dryness reaches execution time L3 for the predetermined normal condition.

The execution time L3 of the drying operation for the normal condition may be set to be longer than execution time L4 of the drying operation for the uniform condition. This may surely prevent non-dryness or uneven dryness of the clothing.

In other words, the execution time of the drying operation for the uniform condition is set to be shorter than the execution time of drying operation for the normal condition. This may enable energy saving drying operation while ensuring to prevent damage or shrinkage of fabrics due to excessive dryness.

If execution time of the drying operation after the operation time before detection of dryness is execution time for the predetermined normal condition (yes in S212), the controller 3 sets the output of the heater 9 to 'off' and switches to cooling control to continue the operation of the fan device 7, in S113. After the laps of cooling time M1 for the predetermined uniform clothing condition, the controller 3 stops the drying operation.

As such, according to the embodiment, the controller 3 of the clothes dryer D controls the drying time L4 after the end of operation time before detection of dryness in the case of satisfying the uniform clothing condition to be shorter than the drying time L3 after the end of operation time before detection of dryness in the case of satisfying the normal condition.

This may ensure to prevent damage or shrinkage of fabrics due to excessive dryness or high temperature and to perform energy saving drying operation.

On the other hand, the controller 3 secures long drying time L3 after the end of operation time before detection of dryness in the case of satisfying the normal condition, and thus ensures to prevent non-dryness or uneven dryness of the clothing.

The aforementioned embodiments may be modified in many different ways.

Other Embodiments

In the above embodiments, the information receiver 33 receives automatically determined size information, but it is also possible that the user may determine the size with his or her naked eyes and input the size to the information receiver 33 through an input panel.

Depending on the size of the object to be dried C received by the information receiver 33, the output setter 34 automatically sets a target output for the heater 9.

Like the above embodiment, if it is received that the object to be dried C is a large sheet, the target output may be set to be smaller than a normal output.

This may enable the target output set for the heater 9 to be changed depending on the size of the object to be dried C and makes it possible to dry the entire object to be dried C evenly if the object is large.

Accordingly, even for a large object to be dried C, it may be dried evenly for almost the same drying time as the normal drying time without waste of energy.

The output setter 34 may set a target output for any other device than the heater 9 as long as it may set a target output of the fan device 7. It is also possible for the output setter 34 to set target outputs of both the heater 9 and fan device 7 depending on the size of the object to be dried C.

The size of an object to be dried may be defined in terms of e.g., a fabric area of a sheet or an amount of fabrics of a sheet. For example, it may be defined by anything that may measure the size of the clothing.

It is also possible to change a mode of drying operation by determining not only the size but also the form of the object to be dried C.

More specifically, based on the measurement measured by the vibration sensor 21, the determiner 31 may also determine the form of the object to be dried C and set a period of time from start to end of a drying process depending on the form determined by the determiner 31.

A basis to change the target output by the output setter 34 is not limited to what is described in the embodiments but may be anything.

For example, it is also possible to configure the dryer D such that the larger the object to be dried C is, the smaller the target output is set. If the target output has more than two steps, it may be set into multiple steps from maximum output to off.

The target output calculated from the size information is basically used as the heating output of the heater 9, but it is still possible to perform control that has thus far been commonly performed to monitor a drying temperature range and reduce the heating output if a temperature above the range is detected.

A method for automatically determining the size of the object to be dried C is not limited to using the electrode sensor but may use other various methods, such as a determination method using a motor armature current to spin the drum. The configuration to change the output of the heater 9 (heating means) or fan device 7 (airing means) based on the determination result may have the same effect as in the above embodiment.

The determination result from the determiner 31 or information about whether it is lumpy (entangled) is used not only for setting the target output but also for e.g., notification to the user through a way of indication, e.g., various characters or pictures.

Although the clothes dryer is assumed to be an exhaust-type clothes dryer in the above embodiments, the present invention may also be applied to convection dryers that circulate air for drying in the clothes dryer, in which case the same effect may be obtained.

The manipulation display 37 may be configured to enable manipulation to pause the drying operation or manipulation to resume drying operation after a pause.

Upon reception of a pause of the drying operation or resumption of the drying operation after a pause by the user from the manipulation display 37, the controller 3 may stop some or all of control based on FIGS. 3 and 5.

This may allows e.g., addition of clothing after a pause, ensures not to degrade accuracy of detection of a type or amount of the clothing even if the temperature in the drum decreases, and ensures to prevent non-dryness or uneven dryness of the clothing.

The manipulation display 37 may be configured to set a heating mode (strong or weak heating mode).

This may allow the user to select whether to do energy saving drying operation or drying operation without unevenness for a short time, according to the user's preference, thereby increasing convenience for the user.

The controller 3 sets the output of the heater 9 to "strong" during the predetermined time Ts after the start of the drying operation, but is not limited thereto. For example, it is also possible to set the output of the heater 9 for this period to "weak". This may enable energy saving drying operation.

It is also possible to combine measurement with the vibration sensor 21 and measurement with the electrode sensor 12.

This may improve accuracy of detection of the size of the clothing, fabric entanglement, etc.

For example, if a vibration value is large and the maximum value of the detection result using the electrode (for 1 second) is large (possibility of entanglement is low), it may be determined that the clothing is large.

If it is determined that the clothing is large, it is possible to change settings according to the user's preference.

For example, if an operation mode selected by the user (at the user's preference) is a course requiring short time, the heating means may be controlled to output high power although the drying efficiency decreases.

On the other hand, for example, if the vibration value is large and the maximum value of the detection result using the electrode (for 1 second) is small, it may be determined that the vibration is caused by entanglement of fabrics. In this case, even if the operation mode selected by the user (at the user's preference) requires short time, it dries only the surface due to the entanglement and causes uneven dryness, thereby degrading the output of the heating means.

It is also possible to change the threshold to distinguish detections into small clothing, normal clothing, large clothing, abnormality (vibration) detected, based on inputs from the detection results of the electrode, an amount of fabrics, humidity, or an extent of vibration.

Figure 18:
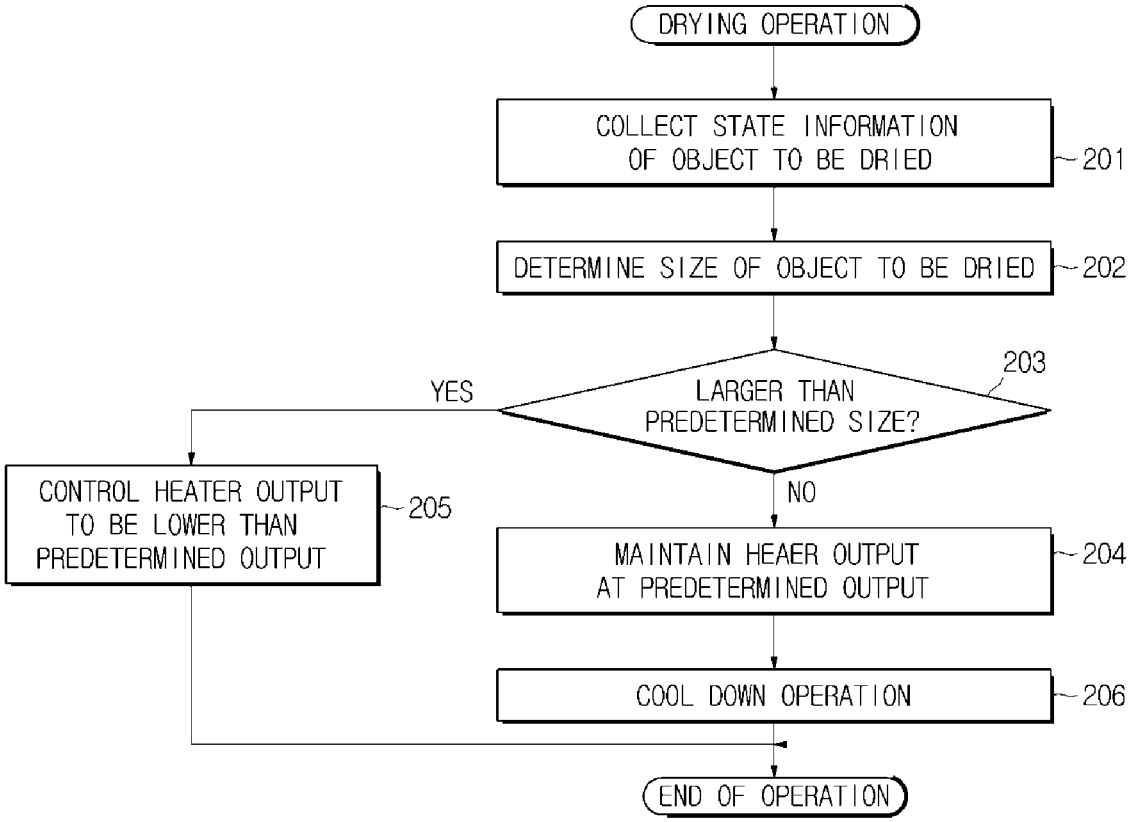
FIG. 18 is a flowchart of a method for controlling a dryer, according to another embodiment.

FIG. 18 is a flowchart of a method for controlling a dryer, according to another embodiment of the present invention.

First, once a drying operation command is input, the dryer sets drying time and starts blowing.

Next, the dryer collects drying object information about a state of an object to be dried in the drum for a predetermined time after the lapse of a certain time from the start of drying operation, in 201.

Collecting the drying object information about a state of an object to be dried includes collecting a change in electric resistance measured from the electrode sensor and collecting a value of vibration measured from the vibration sensor.

Next, the dryer determines the size of the object to be dried based on the drying object information about the state of the object to be dried in 202, and determines whether the determined size is greater than a predetermined size in 203.

Determining the size of the object to be dried may include converting the change in resistance measured from the electrode sensor to a pulse signal and also include determining the amplitude of the vibration value.

The dryer controls the output of the heater to be a predetermined output in 204 if it is determined that the size of the object to be dried is smaller than a predetermined size, and controls the output of the heater to be lower than the predetermined output in 205 if it is determined that the size of the object to be dried is larger than the predetermined size.

Here, the predetermined size may be one belonging to 'large' if the size of the object to be dried is divided into three: large, middle, and small. For example, the size belonging to 'large' may correspond to a size of a bed sheet.

The predetermined output may include an output of the heater in the normal operation, which may be about 5 kW.

Controlling the output of the heater to be lower than the predetermined output may include controlling the output of the heater to be 1.5 kW.

If a certain period of time has lapsed from the start of output control of the heater, the dryer performs cool-down operation in 206, and stops drying operation if the cool-down operation has been completed.

Figure 19:
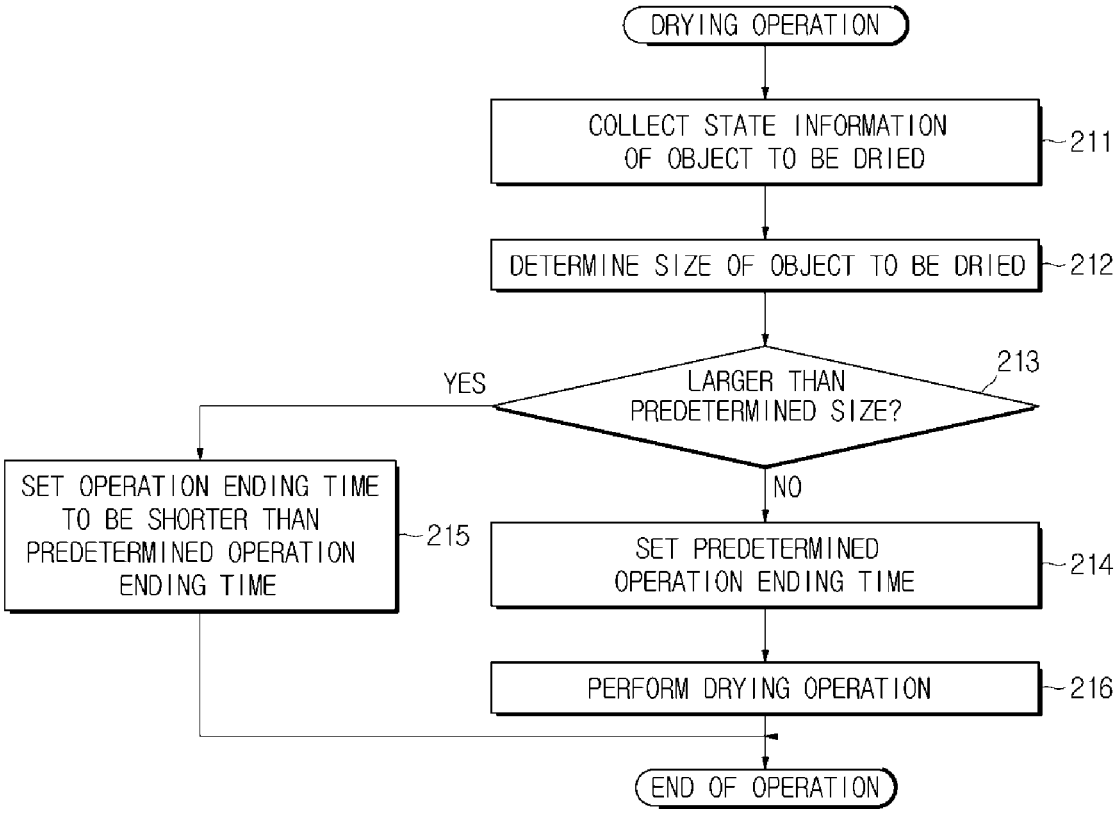
FIG. 19 is a flowchart of a method for controlling a dryer, according to another embodiment.

FIG. 19 is a flowchart of a method for controlling a dryer, according to another embodiment of the present invention.

First, once a drying operation command is input, the dryer sets drying time and starts blowing.

Next, the dryer collects drying object information about a state of an object to be dried in the drum for a predetermined time after the lapse of a certain time from the start of drying operation, in 211.

Collecting the drying object information about a state of an object to be dried includes collecting a change in electric resistance measured from the electrode sensor and collecting a value of vibration measured from the vibration sensor.

Next, the dryer determines the size of the object to be dried based on the drying object information about the state of the object to be dried in 212, and determines whether the determined size is greater than a predetermined size in 213.

Determining the size of the object to be dried may include converting the change in resistance measured from the electrode sensor to a pulse signal and also include determining the amplitude of the vibration value.

The dryer sets operation ending time of the drying operation course to be a predetermined operation ending time in 214 if it is determined that the size of the object to be dried is smaller than a predetermined size, and sets the operation ending time of the drying operation course to be shorter than the predetermined operation ending time in 215 if it is determined that the size of the object to be dried is larger than the predetermined size.

Here, the predetermined size may be one belonging to 'large' if the size of the object to be dried is divided into three: large, middle, and small. For example, the size belonging to 'large' may correspond to a size of a bed sheet.

The dryer performs drying operation in 216, determines if time taken to perform the drying operation reaches the predetermined operation ending time, and stops the drying operation if it is determined that the time taken to perform the drying operation reaches the predetermined operation ending time.

It is also possible to combine or modify various embodiments within the scope not deviating the purpose of the present invention.

INDUSTRIAL APPLICABILITY

As described above, since the present invention may efficiently perform energy saving drying operation depending on a combination of forms or types of clothing to be dried while preventing non-dryness or uneven dryness and damage or shrinkage of fabrics due to excessive drying or high temperature, it is very useful and has high industrial applicability.

The invention claimed is:

1. A dryer comprising:

a drum configured to receive an object to be dried;

a motor configured to rotate the drum;

a blower configured to introduce air into the drum;

a heater configured to heat the air for drying the object;

a vibration sensor configured to detect a value corresponding to a vibration of the drum; and a controller configured to:

collect information about a weight of the object and an amplitude of acceleration of the drum based on the value detected by the vibration sensor, identify a size of the object to be dried based on the collected information, and control the heater to heat the air based on the identified size of the object, wherein the controller is configured to control the heater to stop heating based on the value detected by the vibration sensor being equal to or greater than a threshold.

2. The dryer of claim 1, further comprising:

a clothes distributor configured to agitate and distribute the object to be dried in the drum, and an electrode sensor arranged to be able to contact the object to be dried distributed by the clothes distributor and having electric resistance changing by contact with an object to be dried with moisture, wherein the controller is configured to collect a change in electric resistance of the electrode sensor, convert the change in the electric resistance value detected by electrode sensor to a pulse signal, and determine the size of the object to be dried based on the pulse signal.

3. The dryer of claim 2, wherein the controller is further configured to integrate count the pulse signal during a predetermined period at a beginning of a drying process after a start of drying operation, count a first operation time from the start of drying operation until a pulse signal count per unit time is less than a threshold, and set a strong heating mode to increase a heating intensity of the heater after the first operation time, if a first condition, in which an integration of the pulse signal count is equal to or less than an integration reference value or the first operation time is equal to or longer than a reference time, is satisfied.

4. The dryer of claim 3, wherein the controller is further configured to set the heating intensity of the heater to a weak heating mode weaker than the strong heating mode after the first operation time, if a second condition, in which the integration of the pulse signal count exceeds the integration reference value and the first operation time is shorter than the reference time, is satisfied.

5. The dryer of claim 4, wherein the controller is further configured to control heating mode settings of the heater based on the pulse signal, upon reception of a pause of drying operation and a resumption of drying operation after the pause from a manipulator manipulated by a user.

6. The dryer of claim 4, wherein the controller is further configured to set operation ending time to a predetermined operation ending time if the first condition is satisfied, and set the operating ending time to be shorter than the predetermined operation ending time if the second condition is satisfied.

7. The dryer of claim 2, wherein the controller is further configured to control at least one of revolution per minute (rpm) of the motor, a rotation direction of the motor, a rotation time of the motor, and a rpm of the blower, based on the pulse signal, control at least one of an operation of the drum and an activation of the clothes distributor based on the pulse signal, and control at least one of an extent of movement of the object to be dried and an agitation speed of the object to be dried in the drum.

8. The dryer of claim 2, further comprising:

a temperature measuring means configured to measure at least one of surrounding temperature and temperature of air introduced to the drum from outside, wherein the controller is configured to stop controlling operation ending time or heating mode setting of the heater based on the pulse signal, if the temperature measured by the temperature measuring means is beyond a predetermined temperature range.

9. The dryer of claim 2, wherein the controller is further configured to fix a heating intensity of the heater after a start of drying operation to a heating mode corresponding to a setting signal, if the setting signal to set the heating mode is input from a manipulator.

10. The dryer of claim 1, wherein the vibration sensor arranged in at least one of the drum or a body of the dryer, wherein the controller is configured to set a target output of the heater or the blower based on a result of comparison between a reference value corresponding to the size of the object to be dried and the value corresponding to the vibration of the drum detected by the vibration sensor.

11. The dryer of claim 1, wherein the controller is further configured to store the size of the object to be dried, and size-output relations, which are relations between target outputs of the heater or the blower and the size of the object to be dried, and set a target output of the heater or the blower corresponding to the drying object information collected by the controller, based on the size-output relations.

12. The dryer of claim 11, wherein the controller is further configured to set a first target output in a case that the size of the object to be dried is larger than a predetermined size to be less than a second target output in a case that the size of the object to be dried is smaller than the predetermined size.

* * * * *